US005526013A

United States Patent [19]

Ono et al.

[11] Patent Number: 5,526,013

[45] Date of Patent: Jun. 11, 1996

[54] METHOD OF DRIVING AN ACTIVE MATRIX TYPE LIQUID CRYSTAL DISPLAY

[75] Inventors: Nagamasa Ono; Yoichi Wakai; Masanori Konishi, all of Suwa, Japan

[73] Assignee: Seiko Epson Corp., Tokyo, Japan

[21] Appl. No.: 294,878

[22] Filed: Aug. 23, 1994

Related U.S. Application Data

[63] Continuation of Ser. No. 855,605, Mar. 20, 1992, abandoned.

[30] Foreign Application Priority Data

| | | | |
|---|---|---|---|
| Mar. 20, 1991 | [JP] | Japan | 3-057152 |
| Jun. 21, 1991 | [JP] | Japan | 3-150315 |
| Aug. 6, 1991 | [JP] | Japan | 3-196753 |
| Aug. 6, 1991 | [JP] | Japan | 3-196754 |

[51] Int. Cl.[6] ..... G09G 3/36

[52] U.S. Cl. ..... 345/94; 345/208

[58] Field of Search ..... 345/90, 91, 94, 345/95, 96, 208, 209, 210; 359/54, 55, 57, 58, 59

[56] References Cited

U.S. PATENT DOCUMENTS

| | | | |
|---|---|---|---|
| 4,427,266 | 1/1984 | Hosokawa | 357/57 |
| 4,560,982 | 12/1985 | Sonehara et al. | 340/784 |
| 5,032,831 | 7/1991 | Kuijk . | |
| 5,117,298 | 5/1992 | Hirai | 359/55 |
| 5,159,325 | 10/1992 | Kuijk et al. | 340/84 |
| 5,247,376 | 9/1993 | Wakai . | |

FOREIGN PATENT DOCUMENTS

| | | | |
|---|---|---|---|
| 2187788 | 7/1990 | Japan . | |
| 2187789 | 7/1990 | Japan . | |
| 2173335 | 10/1986 | United Kingdom | 345/94 |

OTHER PUBLICATIONS

Eishi Mizobata, et al., Reliable $SiN_x$ TFD–LCDs without Image Sticking May 6–10, 1991, SID 87 Digest; pp. 226–307 and 54.

*Primary Examiner*—Richard Hjerpe
*Assistant Examiner*—Regina Liang
*Attorney, Agent, or Firm*—Oliff & Berridge

[57] ABSTRACT

In a method for driving an active matrix type liquid crystal display device having a liquid crystal panel having the structure that a set of liquid crystal layers and two-terminal active layers are connected in series between a set of column electrodes and a set of row electrodes, a display operation being carried out by applying a difference signal between each column electrode and each row electrode, the difference signal is set so as to have a voltage having an inverse characteristic to the I-V characteristic of the two-terminal active element and is applied between the column and row electrodes to thereby depress occurrence of flicker. In addition, within a period except for a selection period for which an actual display operation is carried out in the liquid crystal panel, the difference signal having amplitude voltage equal to or above the maximum amplitude voltage set for the display operation is applied between the column and row electrode sets for a predetermined period to thereby prevent degradation of display quality due to the shift characteristic of the two-terminal active element which has been driven, and due to the asymmetry of the voltage-current characteristic of the two-terminal active element between the positive and negative polarity regions thereof.

12 Claims, 27 Drawing Sheets

Fig. 16

| FR | $C_{n-1}$ | $C_n$ | $Y_n$ |
|---|---|---|---|
| H | H | H | +Vr |
| L | H | H | -Vr |
| L | L | H | +Vp |
| L | L | H | -Vp |

METHOD OF DRIVING AN ACTIVE MATRIX TYPE LIQUID CRYSTAL DISPLAY

This is a continuation of application Ser. No. 07/855,605 filed on Mar. 20, 1992, now abandoned.

BACKGROUND OF THE INVENTION

1. Filed of the Invention

This invention relates to an active matrix type of liquid crystal display device for performing a display operation using a two-terminal type active element such as an MIM (Metal-Insulator-Metal) element, an MIS (Metal-Insulator-Semiconductor) element, a ring diode, a varistor or the like, and particularly to a driving method for a liquid crystal display device to compensate for degradation of display quality due to a characteristic of the two-terminal type of active element.

2. Related Background Art

In comparison with a conventional passive type liquid crystal display device, an active matrix type liquid crystal device performs a high contrast display operation, and thus it is widely used in various display fields such as a liquid crystal television, a display terminal of a computer, etc.

As this active matrix type of liquid crystal device has been known a display device in which a two-terminal type active element such as an MIM element, an MIS element, a ring diode, a varistor or the like is installed to perform a switch-driving operation of each picture element, and another type display device in which a three-terminal active element such as a thin film transistor (TFT) is installed to perform the switch-driving operation of each picture element. In comparison with the latter, that is, the display device having the three-terminal type active element, the former, that is, the display device having the two-terminal type active element is more excellent in productivity because of a smaller number of manufacturing steps than the latter, and thus it has been expected to be more remarkably developed in the future.

The conventional types of liquid crystal display devices as described above are disclosed in U.S. Pat. No. 4,560,982, in SID International Symposium Digest of Technical Papers 91, P 226 by NEC Corp., Kawasaki, Japan, in SID International Symposium Digest of Technical Papers 87, P 304 by Seiko Epson Corporation, Nagano, Japan, and in SID International Symposium Digest of Technical Papers 84, P 54 by Suwa Seikosha Co., Ltd., Nagano, Japan.

Such conventional liquid crystal display devices are not equipped with a driving method according to this invention which will be described together with embodiments as described later. Through an earnest study, the inventor of this application has found the cause of degradation of display quality by a conventional driving method of the liquid crystal display device, and has proposed a countermeasure thereto.

The degradation of display quality which is caused by the conventional driving method will be first described in detail using an active matrix type liquid crystal display device of an embodiment (FIG. 1) of this invention as described later.

As shown in FIG. 1, the active matrix type liquid crystal display device comprises a liquid crystal panel 100, an X-drive circuit 200 and a Y-drive circuit 300. Each picture element of the liquid crystal panel 100 is line-sequentially scanned by the X-drive circuit 200 and the Y-drive circuit 300 to perform a display operation.

The liquid crystal panel 100 includes a set of plural column electrodes $X_1$ to $X_M$ (in figure, an m-th column electrode $X_m$ is representatively represented) which are connected to the X-drive circuit 200, another set of plural row electrodes $Y_1$ to $Y_N$ (in figure, n-th row electrode $Y_n$ is representatively represented) which are connected to the Y-drive circuit 300, the set of column electrodes (column electrode set) and the set of row electrodes (row electrode set) being provided on respective facing substrates so as to be intersected to each other, liquid crystal filled in a space between the set of the column electrodes $X_1$ to $X_M$ and the set of the row electrodes $Y_1$ to $Y_N$, and two-terminal active elements each provided to each intersecting portion (picture element portion) between the column electrode and the row electrode). That is, describing representatively using the column electrode $X_m$ and the row electrode $X_n$, a liquid crystal layer 102 serving as a picture element and a two-terminal type active element 103 are connected in series between the column electrode $X_m$ and the row electrode $Y_n$, and the liquid crystal layer 102 and the two-terminal type active element 103 are supplied with a voltage $V_L$ and a voltage $V_D$ through a difference voltage between a column electrode signal $VX_m$ to be supplied to the column electrode $X_m$ and a row electrode signal $HY_n$ to be supplied to the row electrode $Y_n$.

The X-drive circuit 200 is equipped with an a.c. video generating circuit 201 and an X shift register 202. The a.c. video generating circuit 201 receives a video signal P from an external, and outputs an a.c. video signal Ps which is synchronized with an a.c. inversion signal FR.

The X shift register serves to shift a shift start signal DX in synchronism with a shift clock signal $X_{SCL}$ having predetermined frequency $f_X$ to thereby successively generate sampling signals $S_1$ to $S_M$ from respective output contact points corresponding to the column electrodes $X_1$ to $X_M$. In addition, a set of latch circuits and a set of column electrodes driving circuits are provided between the output contact points of the X shift register 202 and the column electrodes $X_1$ to $X_M$.

Detailing representatively a latch circuit and a column electrode driving circuit which are assigned to the m-th column electrode $X_m$, a transmission line 203 through which the a.c. video signal Ps is transmitted is connected to the input contact point of a first analog switch 204 whose conducting and non-conducting states are switched in synchronism with the sampling signal $S_m$, the output contact point of the first analog switch 204 is connected to a first sample-and-hold capacitor 205 and the input contact point of the second analog switch 206. The output contact point of the second analog switch 206 is connected to a second sample and hold capacitor 207 and the input contact point of a buffer amplifier 208, and the output contact point of the buffer amplifier 208 is connected to the column electrode $X_m$.

The first analog switch 204 is switched to a conducting state in synchronism with the switching of the sampling signal $S_m$ to a logical value "H", and the a.c. video signal Ps at that time is held in the sample-and-hold capacitor 205. Thereafter, when the second analog switch 206 is switched to a conducting state in response to the switching of the latch pulse signal LP to a logical value "H", charges which have been accumulatively held in the first sample-and-hold capacitor 205 is transferred to and held in the second sample-and-hold capacitor 207, and the column electrode $X_m$ is supplied with a voltage corresponding to the charges held in the second sample-and-hold capacitor 207 through the buffer amplifier 208.

The Y-drive circuit 300 is equipped with a liquid crystal power generating circuit 301 and a Y shift register 302. The liquid crystal power generating circuit 301 receives four kinds of voltages $V_p$, $-V_p$, $V_a$ and $-V_a$ which satisfy the following inequality: $|V_p|>|V_a|$, where |a| represents an absolute value of a, and carries out a multiplexing operation in synchronism with the a.c. inversion signal FR to output two kinds of liquid crystal voltages $V_S$ and $V_N$ to the transmission lines 303 and 305, respectively. That is, when the a.c. inversion signal FR has a logical value "H", the liquid crystal voltage $V_S$ is equal to the voltage $V_p$, while when the a.c. inversion signal FR has a logical value "L", the liquid crystal voltage $V_S$ is equal to the voltage $-V_p$ and the liquid crystal voltage $V_N$ becomes the voltage $V_a$ or $-V_a$ as described later. The a.c. inversion signal FR is a rectangular signal whose logical value is inverted every horizontal scanning period, and in other words it is a signal whose period corresponds to two horizontal scanning periods.

The Y shift register 302 serves to shift a shift start signal DY in synchronism with a shift clock signal $Y_{SCL}$ having a predetermined frequency $f_Y$ to successively generate selection signals $C_1$ to $C_N$ from respective output contact points for the row electrodes $Y_1$ to $Y_N$. In addition, a set of selection circuits are provided between the respective contact points of the Y shift register 302 and the respective row electrodes $Y_1$ to $Y_N$.

Detailing representatively the switching circuit for the n-th row electrode $Y_n$, a transmission line 303 is connected to the input contact point of a first analog switch 304 whose conducting and non-conducting states are switched in synchronism with a selection signal $C_n$, the output contact point of the first analog switch 304 is connected to the row electrode $Y_n$, a transmission line 305 is connected to the input contact point of a second analog switch 306 whose conducting and non-conducting states are switched in the opposite manner to that of the first analog switch 304 in synchronism with the selection signal $C_n$, and the output contact point of the second analog switch 306 is connected to the row electrode $Y_n$.

When the selection signal $C_n$ has a logical value "H", the first analog switch 304 and the second analog switch 306 are switched to the conducting state and the non-conducting state respectively, so that the liquid crystal voltage $V_S$ is supplied to the row electrode $Y_n$. Inversely, when the selection signal $C_n$ has a logical value "L", the first analog switch 304 and the second analog switch 306 are switched to the non-conducting state and the conducting state respectively, so that the liquid crystal voltage $V_N$ is supplied to the row electrode $Y_N$. In figures, signals to be supplied to the respective row electrodes $Y_1$ to $Y_N$ are represented by row electrode signals $HY_1$ to $HY_N$.

Each two-terminal active element has a voltage-current characteristic (I-V characteristic) as shown in FIG. 2, which varies in accordance with voltage variation of the signals $VX_1$ to $VX_M$ and $HY_1$ to $HY_N$ which are supplied to the column electrodes $X_1$ to $X_M$ and the row electrodes $Y_1$ to $Y_N$, respectively. Apparently from FIG. 2, the two-terminal active element has a non-linear characteristic in which a remarkable small amount of current flows through the two-terminal active element when a low voltage is supplied between both ends of the element, but the current is rapidly increased when a high voltage is supplied between both ends of the element. On the basis of the non-linearity of the characteristic of the two-terminal active element as described above, the two-terminal active element is supplied with a high voltage to perform a display operation (at a selection time), and with a low voltage to perform a non-display operation (at a non-selection time), whereby the driving of the liquid crystal is carried out.

The operation of the active matrix type liquid crystal display device thus constructed will be next described with reference to timing charts of FIGS. 3 and 4.

For example, assuming that a video signal P as shown in FIG. 3 is input to the a.c. video generating circuit 201, the phase of the video signal P remains invariable when the a.c. inversion signal FR has the logical value "H" while the phase is inverted to an opposite phase when the a.c. inversion signal FR has the logical value "L", and then the video signal P is outputted to the transmission line 203. A period for the former case is referred to as a non-inversion period, and a period for the latter case is referred to as an inversion period. Therefore, the a.c. video signal Ps is varied as shown in FIG. 3.

Here, the voltage $V_S$ of the a.c. video signal Ps has a 100% level for white at the non-inversion phase period and a 0% level (corresponding to a pedestal level) for white for the inversion phase period. Further, the voltage $(-V_a)$ is a 0% level (corresponding to the pedestal level) for white for the non-inversion period and a 100% level for white for the inversion phase period.

The Y shift register 302 serves to shift a shift start signal DY in synchronism with a shift clock signal $Y_{SCL}$ having a period corresponding to a horizontal scanning period to successively generate selection signals $C_1$ to $C_N$.

Each of the latch pulse signal LP and the shift start signal DX which are applied to the X-drive circuit 200 is a rectangular signal which has a logical value "H" in matching with the one-horizontal scanning period.

Next, an operation every one-horizontal scanning period will be described in detail with reference to an enlarged time chart at the lower side of FIG. 3. The latch pulse signal LP is switched to a state of a logical value "H" substantially in synchronism with the time when the a.c. video signal Ps is phase-inverted, and the shift start signal DX is switched to a state of a logical value "H" at the start time within each one-horizontal scanning period for which the a.c. video signal Ps exists. Further, the shift clock signal $X_{SCL}$ is provided with a sufficiently high frequency to enable the X shift register 202 to perform an M-stage shift operation within a period from the time when the shift start signal DX takes "H" until the time when the latch pulse signal LP takes "H".

Therefore, the X shift register 202 shifts the shift start signal DX in synchronism with the shift clock signal $X_{SCL}$, thereby generating the sampling signals $S_1$ through $S_m$ to $S_M$ in synchronism with the shift clock signal $X_{SCL}$.

The sampling signals $S_1$ to $S_M$ and the latch pulse signal LP are generated every one-horizontal scanning period for which a set of the row electrodes $Y_1$ to $Y_N$ are successively scanned by the Y-drive circuit 300, so that the liquid crystal layer corresponding to picture element portions of the liquid crystal panel 100 are line-sequentially scanned by the signals $VH_1$ to $VX_M$ and $VX_1$ to $HY_N$.

The timing at which the a.c. video signal Ps is held in the set of the first sample-and-hold capacitors of the X-drive circuit 200 is shifted by one horizontal period from the timing at which the charges held in the set of the first sample-and-hold capacitors are transferred to the set of the second sample-and-hold capacitors in synchronism with the latch pulse signal LP to simultaneously supply the column electrode signals $VX_1$ to $VX_M$ to the column electrodes $X_1$ to $X_M$.

For example, an n-th a.c. video signal Ps which has been sampled with a sampling signal $S_m$ as shown in FIG. 3 (in figure, a sampling position is represented by a circle) is transferred to the column electrode $X_m$ in synchronism with the sampling timing of an (n+1)-th a.c. video signal Ps after one horizontal scanning period elapses from the sampling time of the n-th a.c. video signal Ps.

FIG. 4 shows timing charts representatively for a difference signal ($VX_m$–$HY_n$) applied between the column electrode $X_m$ and the row electrode $Y_n$ of difference signals ($VX_1$–$HY_1$) to ($VX_m$–$HY_n$) which are applied at the intersecting portions between the set of column electrodes $X_1$ to $X_M$ and the set of row electrodes $Y_1$ to $Y_N$.

The a.c. video signal Ps as shown in FIG. 4 corresponds to the a.c. video signal Ps as shown in FIG. 3, and the voltage levels $V_a$ and $-V_a$ correspond to 100% and 0% levels for white respectively for the non-inversion phase period, and 0% and 100% for white respectively for the inversion-phase period.

The row electrode signal $HY_n$ is equal to the liquid crystal voltage $V_S$ for a selection period (a period for which the selection $C_n$ is in a state of logical value "H") Ts, and is equal to the liquid crystal $V_N$ for a non-selection period (a period for which the selection signal $C_n$ is in a state of logical value "L") $T_N$. Within the non-inversion phase period as described above, after the potential of the row electrode $Y_n$ is a positive potential $V_p$ for the selection period $T_S$, it is changed to a potential $V_a$ for the non-selection period $T_N$, while after the potential of the row electrode $Y_n$ is a negative potential $-V_p$ for the selection period $T_S$, it is changed to a potential $-V_a$ for the non-selection period $T_N$. Further, the column electrode signal $VX_m$ is formed by sampling and holding the a.c. video signal Ps as described with reference to FIG. 3.

On the basis of the relationship of the potentials of the electrodes as described above, the difference signal ($VX_m$–$HY_n$) has a waveform as shown by a solid line at the lower side of FIG. 4. A chain line of FIG. 4 shows a trace of potential variation at a contact portion of the liquid crystal layer 102 and the non-linear element 103. For the selection period $T_S$, the two-terminal active element 103 is supplied with a large voltage, and thus apparently from the I-V characteristic of FIG. 2, a current flowing through the two-terminal active element is increased, so that the liquid crystal layer 102 is charged. The charge amount of the liquid crystal layer 102 corresponds to the amplitude of the difference signal ($VX_m$–$HY_n$) for the selection period $T_S$. In other words, the charge amount is controlled by the level of the electrode signal $VX_m$, and thus the sampling level of the a.c. video signal $P_S$. As described above, a non-selection potential (a potential for the non-selection period) is variable in accordance with the polarity of a selection potential (a potential for the selection period) prior to the non-selection potential, so that the difference signal ($VX_m$–$HY_n$) has a positive level for a non-selection period $T_N$ after a selection period $T_S$ of positive polarity, but has a negative level for a non-selection period after a selection period $T_S$ of a negative polarity. Therefore, the voltage to be supplied to the two-terminal active element 103 for the non-selection period $T_N$ in both of the above cases is small, and thus the charges which have been charged into the liquid crystal layer 102 for the selection period $T_S$ are hardly discharged through the two-terminal active element. An effective voltage to be supplied to the liquid crystal layer 102 is proportional to the area of an oblique portion of FIG. 4, and is consequently dependent on the level of the sampled a.c. video signal Ps. The liquid crystal layer 102 serves to control light-transmissive amount in accordance with an effective voltage supplied thereto, and display an image on the liquid crystal panel 100.

If the driving method as shown by the timing chart of FIGS. 3 and 4 is used in place of the driving method of this invention in the active matrix type liquid crystal display device having two-terminal active elements, the following problems such as the degradation of display quality would occur due to the electrical characteristics of the two-terminal active element.

(First problem): MIM elements, MIS elements and other two-terminal active elements have an non-linear I-V characteristic as shown in FIG. 2. These elements are driven with a low voltage V at a non-selection time, and driven with a high voltage at a selection time to control charging and discharging operations of the liquid crystal layer for image display performance.

However, in the I-V characteristic of the actual two-terminal active element as shown in FIG. 2, the current I with the applied voltage of positive polarity (V) and the current –I with the applied voltage of negative polarity (–V) are not symmetrical to each other with respect to the origin of coordinates, and for example show an symmetrical characteristic as shown in FIG. 5 (as shown by absolute values). This asymmetrical characteristic of the actual two-terminal active element causes degradation of display quality. A problem occurring in a case as shown in FIG. 5, that is, in a case where the I-V characteristic for the applied voltage V having positive polarity is represented by a solid line a and the I-V characteristic for the applied voltage V having negative polarity is represented by a chain line b, will be described hereunder with reference to a timing chart of FIG. 4. The voltage $V_L$ applied to the liquid crystal layer 102 when the difference signal ($VX_m$–$HY_n$) has negative polarity is represented by a dotted line A of FIG. 4 while the voltage $V_L$ applied to the liquid crystal layer 102 when the difference signal ($VX_m$–$HY_n$) has positive polarity is represented by a dotted line C of FIG. 4. Apparently from FIG. 4, the absolute values of both of the applied voltages are different from each other between the above two cases. Therefore, there occurs a case where 0 V potential of the effective voltage to be supplied to the liquid crystal layer (as indicated by a one-dotted chain line OB in FIG. 4) is deviated from that at an ideal state by $\Delta V$, and thus a d.c. (direct current) offset voltage is applied to the liquid crystal layer. This offset voltage causes the liquid crystal panel to flicker and thus causes the display quality thereof to be degraded. In addition, the offset voltage also causes deterioration of the liquid crystal panel with time lapse, so that the reliability of the liquid crystal panel is reduced.

(Second problem): In addition, the MIM elements, the MIS elements and the other two-terminal active elements do not have necessarily an invariable single I-V characteristic as shown in FIG. 2, but have a characteristic which varies in accordance with a continually-applied voltage V as shown in FIGS. 6 and 7. FIG. 6 shows variation of the I-V characteristic with an applied voltage, in which an initial I-V characteristic as indicated by a solid line c is changed to that as indicated by a dotted line d due to a continually-applied voltage V, and FIG. 7 shows a variation amount (hereinafter referred to as "shift amount") of the I-V characteristic with variation of a voltage-applying time for each applied voltage. As shown in FIG. 6, even if the two-terminal active element has the I-V characteristic as indicated by the solid line c of FIG. 6 at the initial stage of the voltage application, the initial I-V characteristic is varied to that as indicated by the dotted line d of FIG. 6 after a time elapses, and stabilized to the I-V characteristic after the variation.

When the two-terminal active element is left for several hours while the applied voltage to the element is set to 0 volt, the I-V characteristic after variation is returned to the initial I-V characteristic as indicated by the solid line c. However, applying the voltage V to the two-terminal active element at the same condition again, the I-V characteristic as indicated by the solid line c is varied to that as indicated by the dotted line d. This variable characteristic (hereinafter referred to as "shift characteristic") differs in accordance with difference in applied voltage V (for example, in FIG. 7, the voltage V satisfies the following inequality: p>r>n>f, and the shift characteristics of the respective I-V characteristics are different from each other). A time required for the I-V characteristic varied due to the continually-applied voltage to return to the initial I-V characteristic is longer as the shift amount (the variation amount as indicated by an arrow of FIG. 6) is increased. The shift characteristic is described in more detail in "E. Mizobatta, et al: SID 91 Digest, p.226 (1991)" or other papers.

In addition, there is a problem that the shift characteristic causes the occurrence of an afterimage on the liquid crystal panel. For example, it is assumed that a window pattern having a white portion at the center portion thereof and a black portion surrounding the white portion is first displayed on the liquid crystal panel as shown in FIG. 8(*a*), and then is changed to an overall white pattern (white raster). In this case, the first displayed window pattern is not completely erased, and it is left behind as an afterimage on the liquid crystal panel as shown in FIG. 8(*b*), so that the overall white pattern is not obtained on the liquid crystal panel. This so-called afterimage phenomenon is gradually extinguished as a long time elapses, but the display quality is remarkably degraded. The principle of occurrence of the afterimage phenomenon will be further described hereunder. In a case where the window pattern as shown in FIG. 8(*a*) is displayed in a normally black mode (it is black when a sufficient voltage is not applied to the liquid crystal layer, and white when a sufficient voltage is applied to the liquid crystal layer), the white display portion is supplied with a difference signal of applied voltage n as show in FIG. 8(*c*) for the selection period $T_S$, while the black display portion is supplied with a difference signal of applied voltage f (f<n) for the selection period $T_S$. Therefore, the two-terminal active element located at the white display portion is supplied with a higher voltage than that located at the black display portion, so that apparently from FIGS. 6 and 7, the shift amount of the I-V characteristic of the two-terminal active element at the white display portion is larger than that of the two-terminal active element at the black display portion. Here, assuming that the whole screen of the liquid crystal panel is changed to the white pattern, the afterimage as shown in FIG. 8(*b*) occurs due to the difference of the shift amounts of the two-terminal active elements at the white and black display portions.

The afterimage phenomenon also occurs in a case where a window pattern having a white portion at the center portion of the liquid crystal panel and a black portion surrounding the white portion is first displayed on the liquid crystal panel, and then the whole screen of the liquid crystal panel is changed from the above display pattern to a display pattern having a half tone, and also in a case where a pattern having a half tone is first displayed on the liquid crystal panel, and then the display pattern is changed from the above pattern to a pattern having different half tone which is set with a lower voltage that the former pattern.

The afterimage phenomenon due to such an display pattern changing operation to a half tone pattern will be described in more detail. For example, the following assumption is introduced. As shown in FIG. 9, white and black are first displayed at the center portion and the surrounding portion of the liquid crystal panel, respectively, in which the black portion P1 is formed by a difference signal ($VX_{m1}$–$HY_n$) which is applied through the column electrode $_{m1}$ and the row electrode $Y_n$ and the white portion P2 is formed by a difference signal ($VX_{m2}$–$HV_n$) which is applied through the column electrode $X_{m2}$ and the row electrode $Y_n$, and thereafter the display pattern changing operation to a half tone pattern is carried out by applying difference signals ($VX_{m1}$–$HY_n$) and ($VX_{m2}$–$HV_n$) which are equal to each other, so that an afterimage in which the central portion P2 is darker than the surrounding portion P1 as shown in FIG. 10.

In such a case, the difference signals ($VX_{m1}$–$HY_n$) and ($VX_{m2}$–$HY_n$) are applied in accordance with timing charts as shown in FIG. 11. That is, for each selection period $T_S$ (in a case of_normally black display) within a period for which black and white are displayed, the voltage $V_{msB}$ of the difference signal ($VX_{m1}$–$HY_n$) which is applied to the two-terminal active elements for the black portion P1 is lower than the voltage $V_{msW}$ of the difference signal ($VX_{m2}$–$HY_n$) which is applied to the two-terminal active elements for the white portion P2. Therefore, apparently from FIGS. 6 and 7, the shift amount of the two-terminal active element for the portion P2 is larger than that of the two-terminal active element for the portion P1. In other words, the internal impedance of the two-terminal active element for the portion P2 is increased while the internal impedance of the two-terminal active element for the portion P1 is lower than the former, and this characteristic is maintained.

When the display pattern is changed from this state to a half tone display pattern, the amount of charges Q2 flowing into the liquid crystal layer through the two-terminal active element for the portion P2 is smaller that the amount of charges Q1 flowing into the liquid crystal layer through the two-terminal active element for the portion 1 within a half tone display period although the voltage $V_{ms1}$ of the difference signal ($VX_{m1}$–$HY_n$) and the voltage $V_{ms2}$ of the difference signal ($VX_{m2}$–$HY_n$) which are supplied for the selection period $T_S$ are voltages for the same half tone. Therefore, the effective voltage (which is proportional to the charge amount Q2) applied to the liquid crystal layer for the portion P2 for a non-selection period $T_N$ within the half tone display period is represented by an oblique portion S2 in FIG. 11 while the effective voltage (which is proportional to the charge amount Q1) applied to the liquid crystal layer for the portion P1 is represented by an oblique portion in FIG. 11, and thus the following inequality is apparently satisfied: S1>S2. Therefore, a dark afterimage is formed at the portion P2 while a predetermined half tone image is formed at the portion P1. Such an afterimage phenomenon is called as "sticking phenomenon".

SUMMARY OF THE INVENTION

This invention has been implemented in view of the problem of the degradation of display quality due to occurrence of flicker and afterimage phenomenon, and has overcome the problem by compensating for the characteristic of an active two-terminal active element using a novel method for driving a liquid crystal panel. Therefore, this invention has an object to provide an active matrix type liquid crystal display device having excellent display quality, and a method for driving the same.

In order to attain the above object, this invention relates to a method for driving an active matrix type of liquid crystal display device having a liquid crystal panel in which a set of liquid crystal layers and two-terminal active elements are connected in series between a set of column electrodes and a set of row electrodes, and a difference signal is applied to intersecting portions between the sets of column electrodes and row electrodes to perform a display operation on the liquid crystal panel, the difference signal being set to a voltage having an inverse characteristic to the I-V characteristic of the two-terminal active element, and supplied to the sets of column electrodes and row electrodes. According to the driving method of this invention, the difference signal set to the voltage having the inverse characteristic to the I-V characteristic of the two-terminal active element is supplied to the sets of the column electrodes and the row electrodes, so that although the I-V characteristic of the two-terminal active element is asymmetrical between positive and negative polarities, the asymmetry of the voltage of the difference signal counteracts, that is, compensate for the asymmetry of the I-V characteristic of the two-terminal active element. Therefore, the occurrence of a direct current offset component in the liquid crystal layer due to the asymmetry is reduced, so that the occurrence of flicker and so on can be depressed and the deterioration of the liquid crystal panel with time lapse can be also prevented.

Further, within a period for which the liquid crystal panel is driven to carry out the substantially display operation, that is, within a period except for the selection period, a difference signal of a voltage having the maximum amplitude set for the display operation or amplitude exceeding the maximum amplitude is intentionally applied to the sets of the column electrodes and the row electrodes for a predetermined period. According to this driving method, since within a period for which the liquid crystal panel is driven to carry out the substantially display operation (within a period except for the selection period), the difference signal of a voltage having the maximum amplitude set for the display operation or amplitude exceeding the maximum amplitude is applied to the sets of the column electrodes and the row electrodes for the predetermined period, the I-V characteristic of the two-terminal active element is fixed to the I-V characteristic for the voltage of the difference signal, so that the occurrence of the afterimage phenomenon due to variation of I-V characteristic in the effective display operation can be depressed, and the display quality can be improved.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

BRIEF DESCRIPTION OF THE DRAWINGS

FIG. 16 is an explanatory diagram showing the principle of forming a row electrode signal in the active matrix type liquid crystal display device to which the second embodiment is applied;

DESCRIPTION OF THE PREFERRED EMBODIMENT

Figure 1:
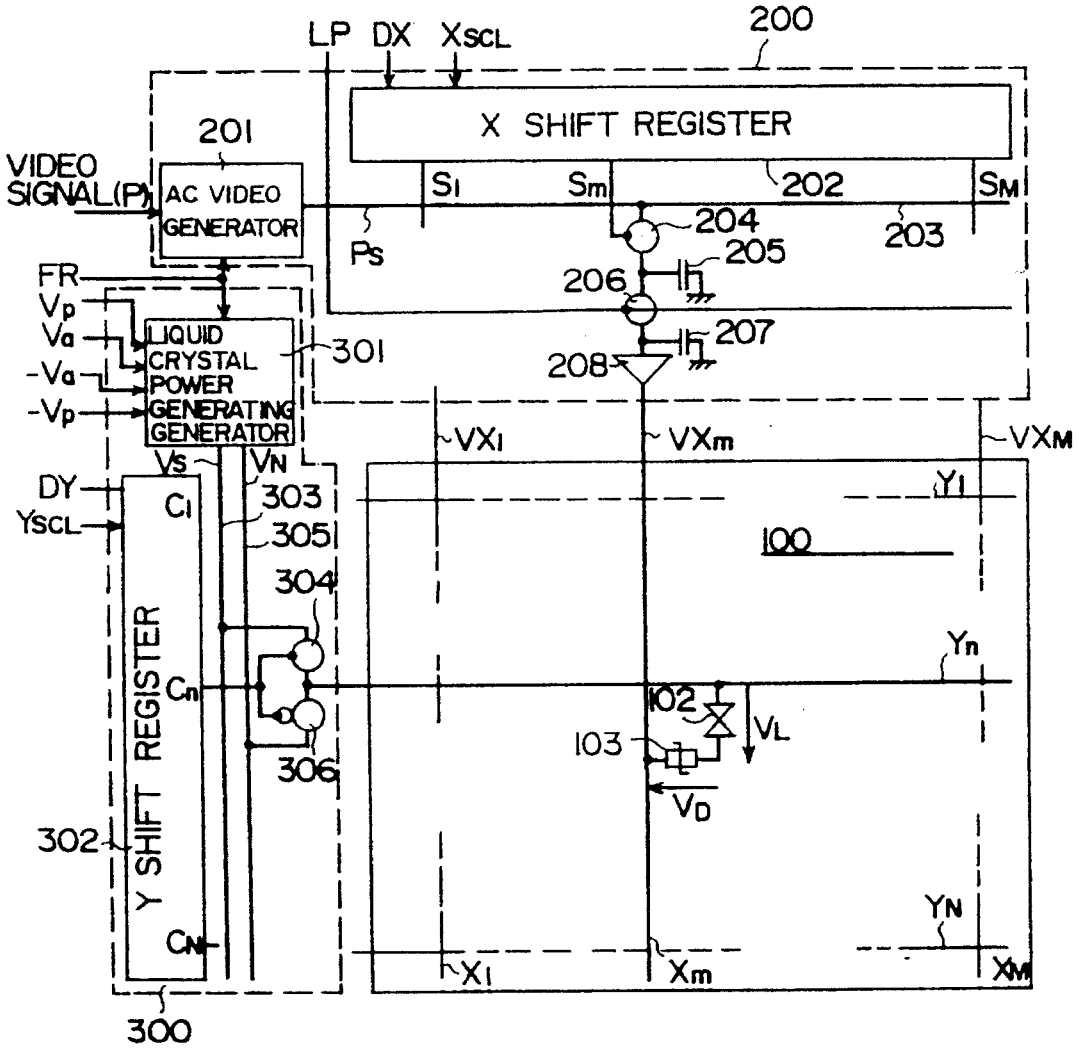
FIG. 1 is a block diagram showing the construction of an active matrix type liquid crystal display device to which an embodiment of a driving method according to this invention is applied.
Figure 2:
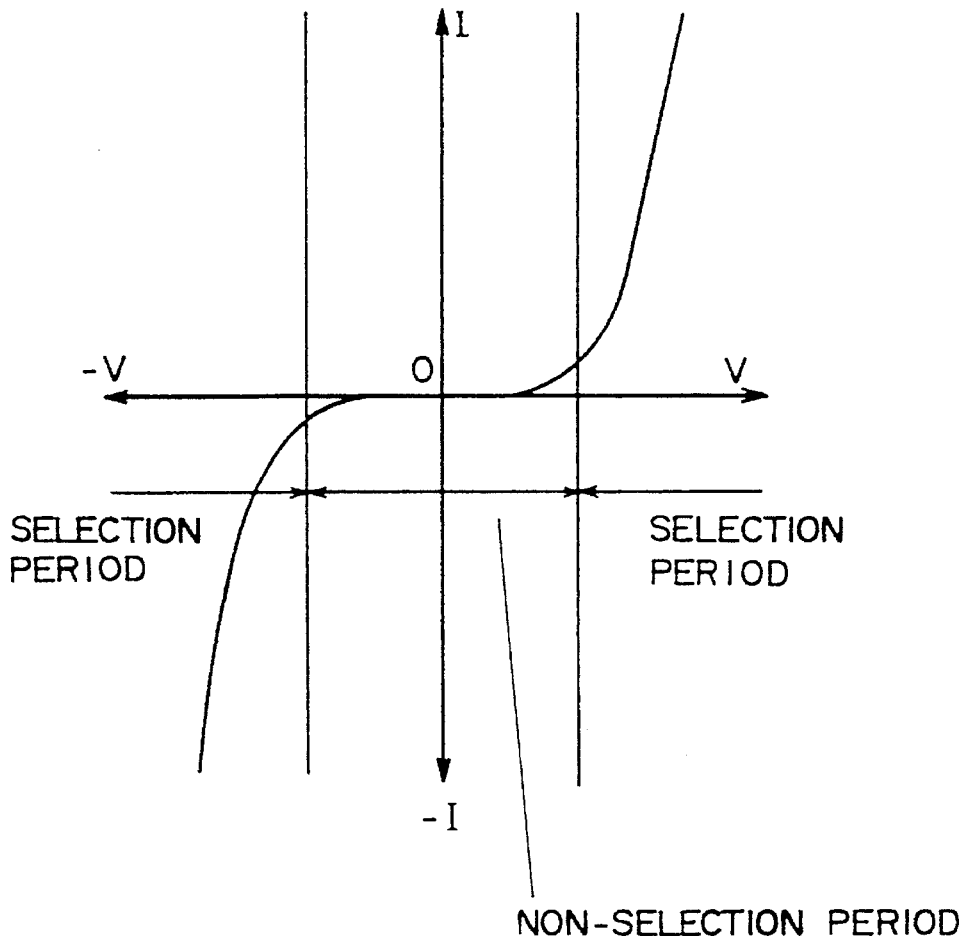
Fig. 2 PRIOR ART
FIG. 2 is a graph showing an I-V characteristic of a two-terminal active element for driving a liquid crystal layer.

A first embodiment of this invention will be hereunder described with reference to the accompanying drawings. This embodiment relates to a driving method for an active matrix type liquid crystal display device, which is implemented in view of the degradation of display quality (first problem) due to the asymmetry of the I-V characteristic of a two-terminal active element at positive and negative parity regions thereof. This embodiment of the driving method according to this invention is applied to the active matrix type display device as shown in FIG. 1, and the construction thereof is the same as described above. However, in this embodiment, the asymmetry of the I-V characteristic of the two-terminal active element as described above is compensated by driving a set of column electrodes (column electrode set) and a set of row electrodes (row electrode set) in accordance with timing charts as shown in FIG. 12 (corresponding to FIG. 3) and FIG. 13 (corresponding to FIG. 4).

Figure 3:
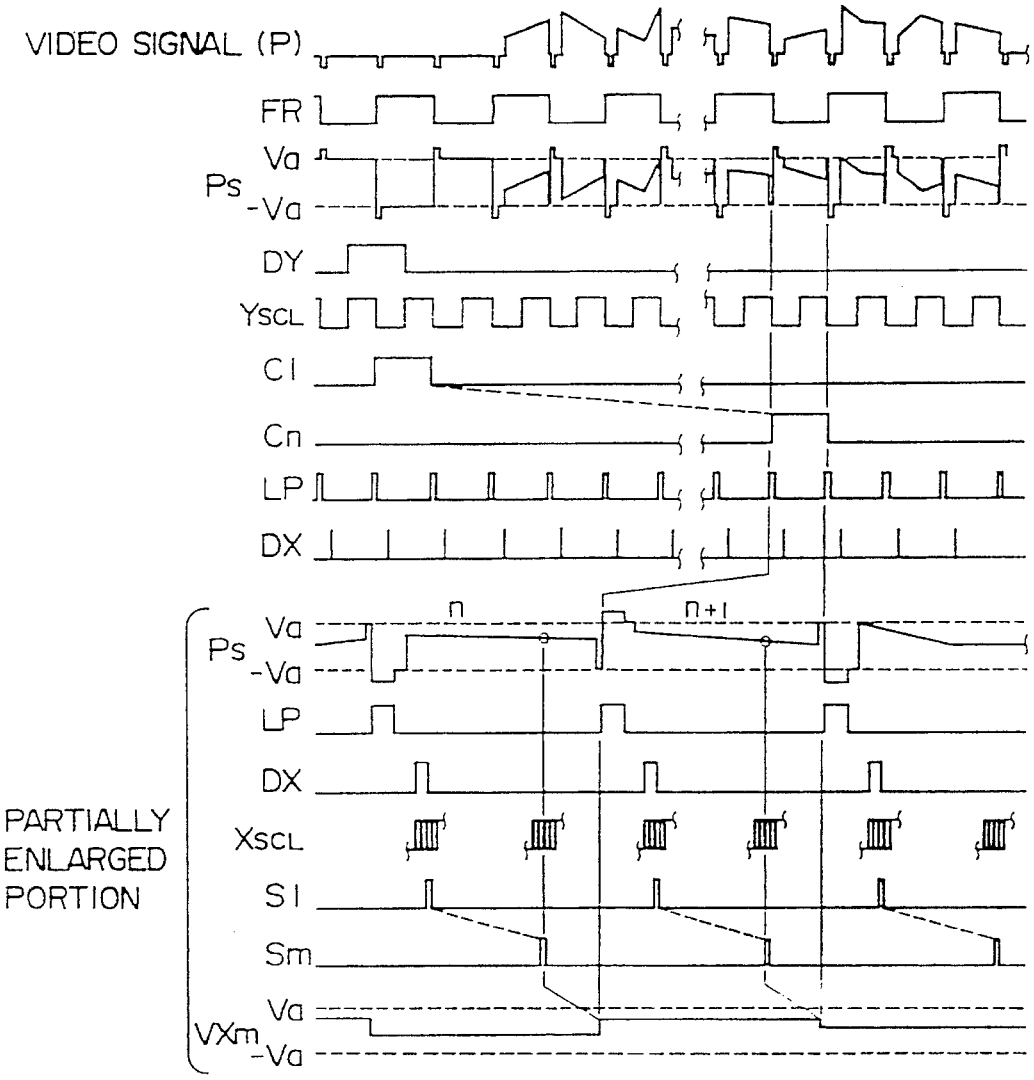
Fig. 3 PRIOR ART
FIG. 3 is a timing chart for explaining a problem of a conventional driving method.
Figure 4:
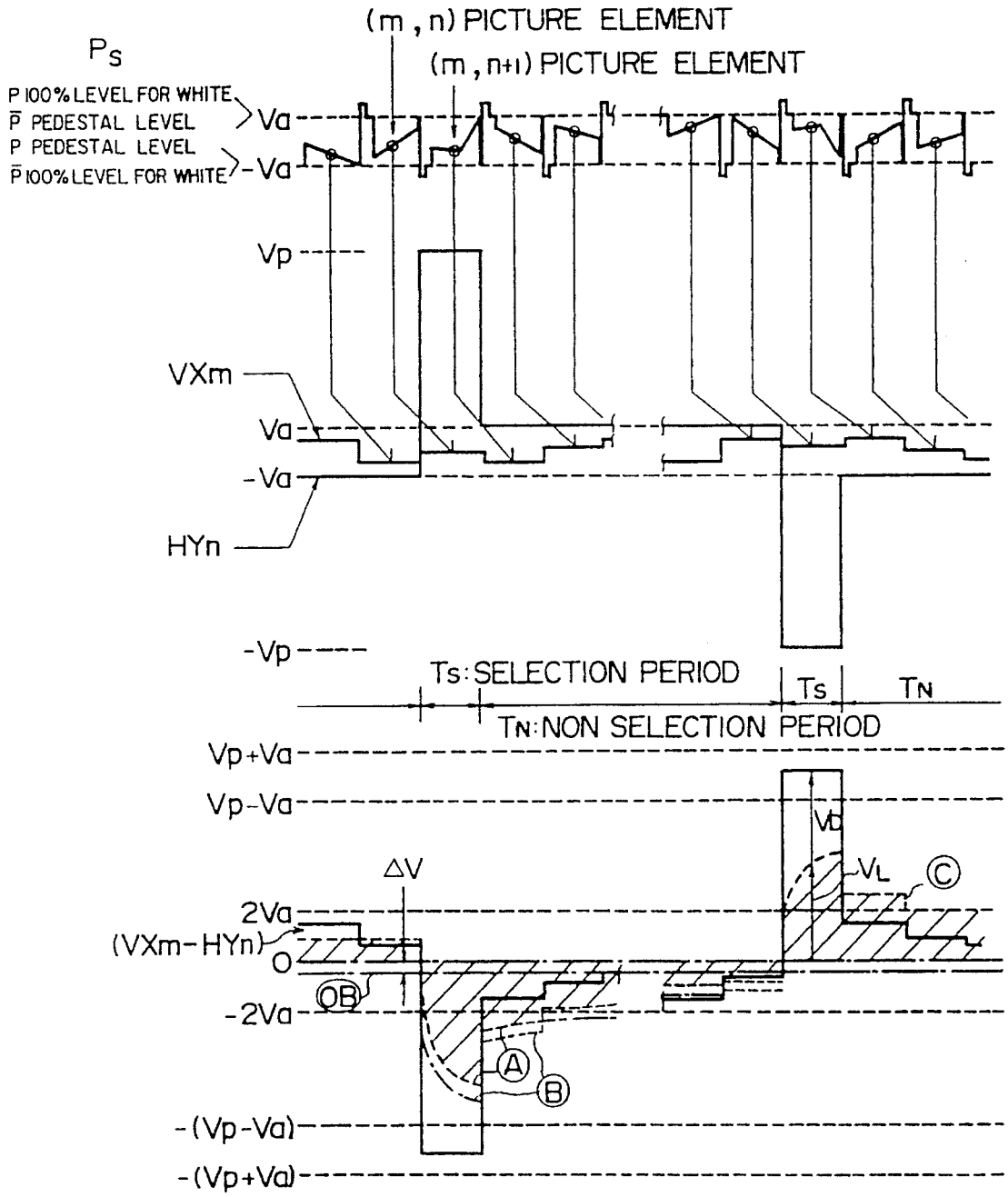
Fig. 4 PRIOR ART
FIG. 4 is a timing chart for further explaining the problem of the conventional driving method.
Figure 12:
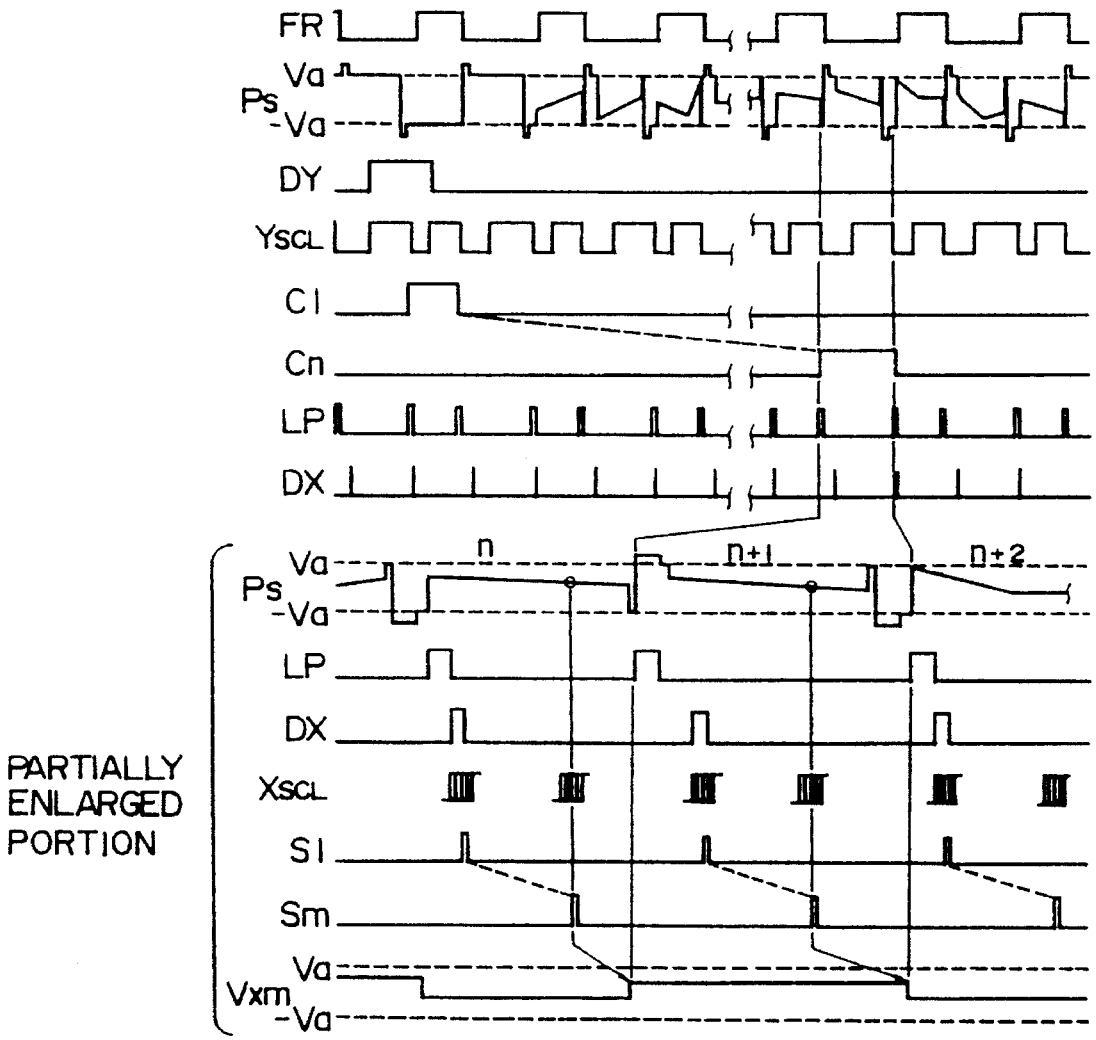
FIG. 12 is a timing chart showing a first embodiment of the driving method according this invention.

First, as shown in FIG. 12, the a.c. video signal Ps is generated in synchronism with the a.c. inversion signal FR as described with reference to FIG. 3. However, the timing chart of this embodiment differs from that of the conventional driving method as shown in FIG. 3 in that a period for which the a.c. inversion signal has a logical value "H" (the liquid crystal layer is driven with a difference signal having positive polarity) and a period for which the a.c. inversion signal has a logical value "L" (the liquid crystal layer is driven with a difference signal having negative polarity) within each period of the a.c. inversion signal FR are not equal to each other, that is, different from each other.

Figure 5:
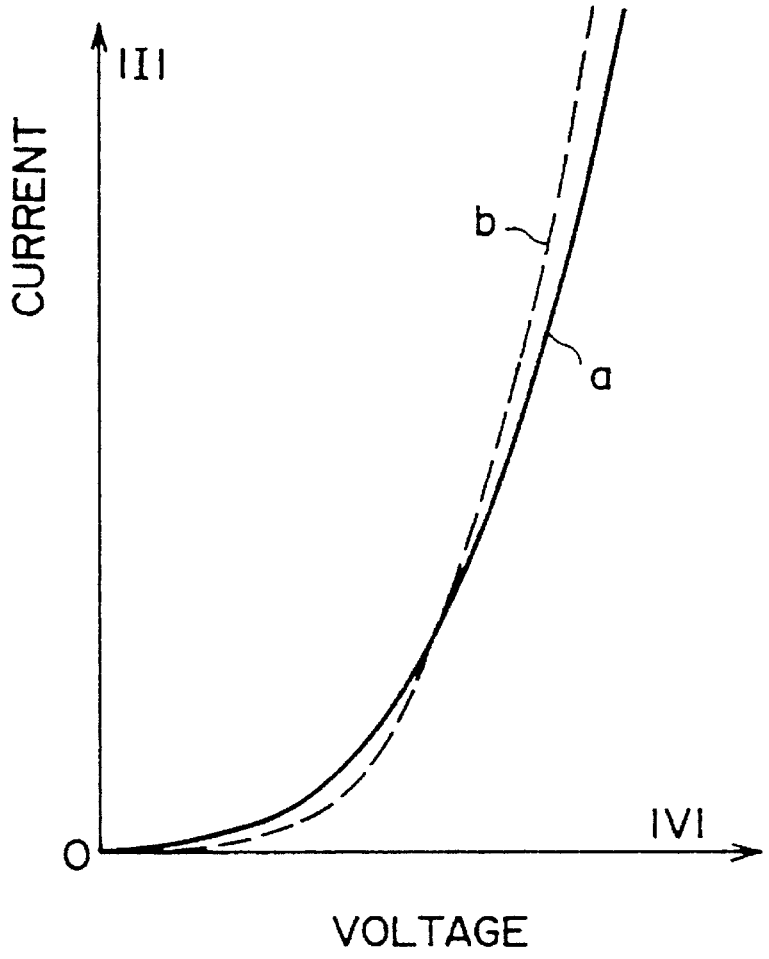
Fig. 5 PRIOR ART
FIG. 5 is a graph showing a problem caused by the I-V characteristic of the two-terminal active element for driving the liquid crystal layer.
Figure 6:
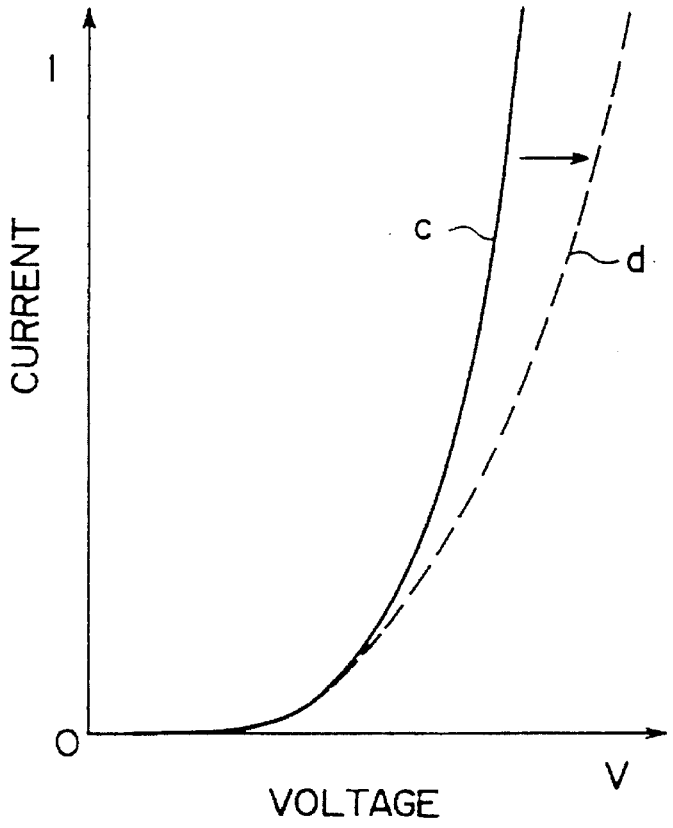
Fig. 6 PRIOR ART
FIG. 6 is a graph showing another problem caused by the I-V characteristic of the two-terminal active element for driving the liquid crystal layer.
Figure 7:
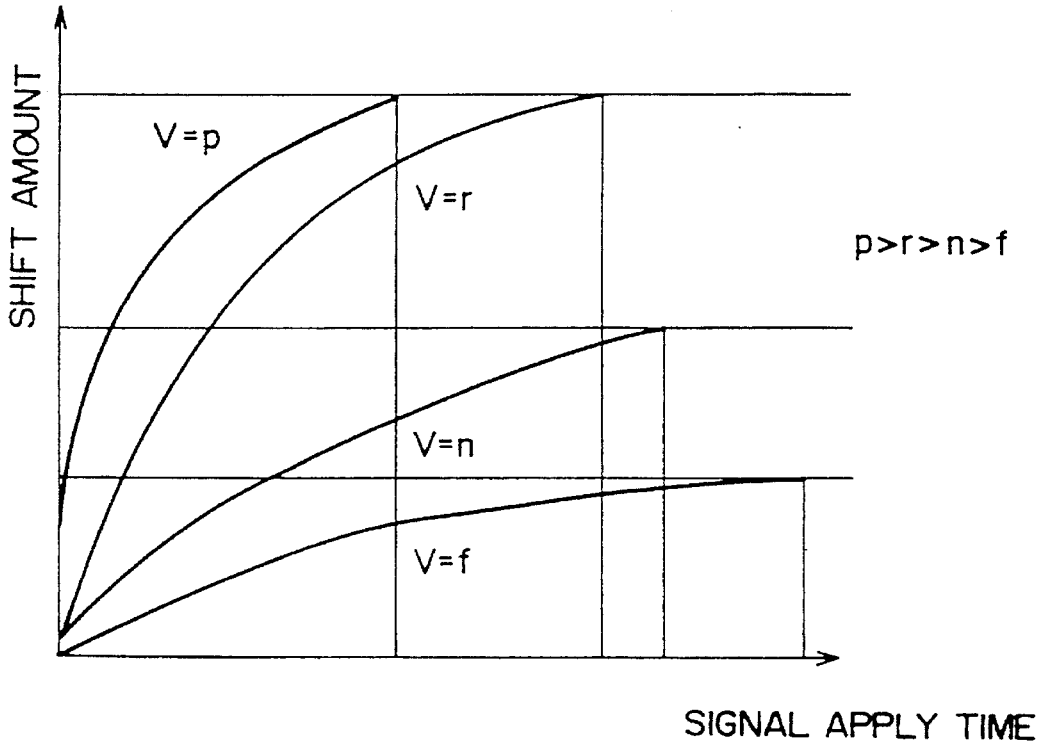
Fig. 7 PRIOR ART
FIG. 7 is a graph showing another problem caused by the I-V characteristic of the two-terminal active element for driving the liquid crystal layer.
Figure 8A:
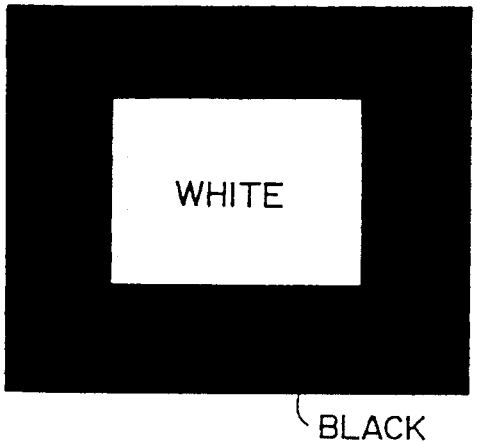
Fig. 8A PRIOR ART
FIGS. 8(*a*)–8(*d*) is a schematic view showing the principle of occurrence of an afterimage due to the I-V characteristic of the two-terminal active element for driving the liquid crystal layer.
Figure 8B:
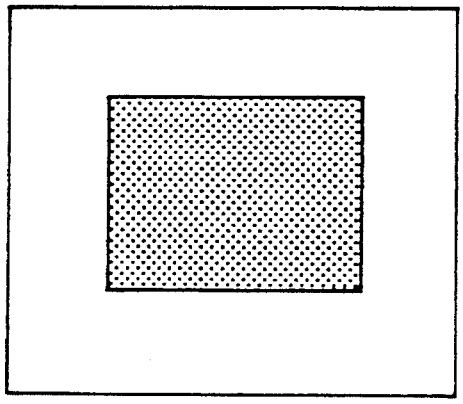
Fig. 8B PRIOR ART
Figure 8C:
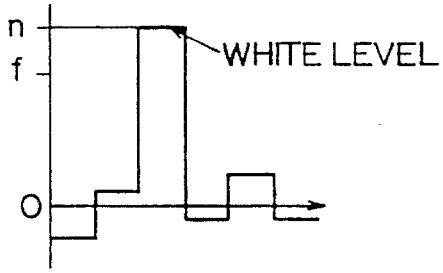
Fig. 8C PRIOR ART
Figure 8D:
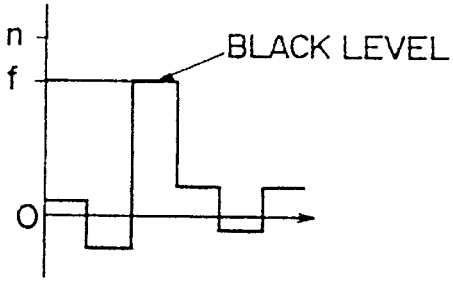
Fig. 8D PRIOR ART
Figure 9:
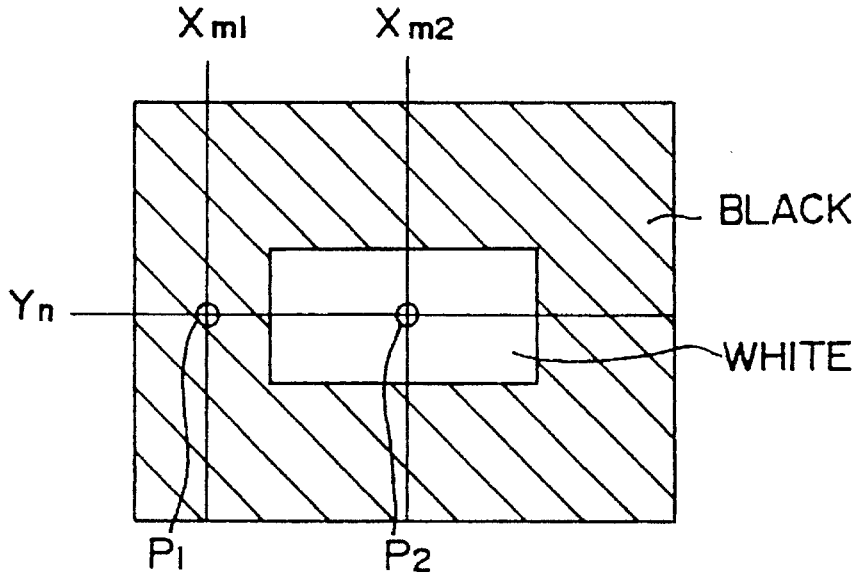
Fig. 9 PRIOR ART
FIG. 9 is a schematic view further showing the principle of occurrence of the afterimage due to the I-V characteristic of the two-terminal active element for driving the liquid crystal layer.
Figure 10:
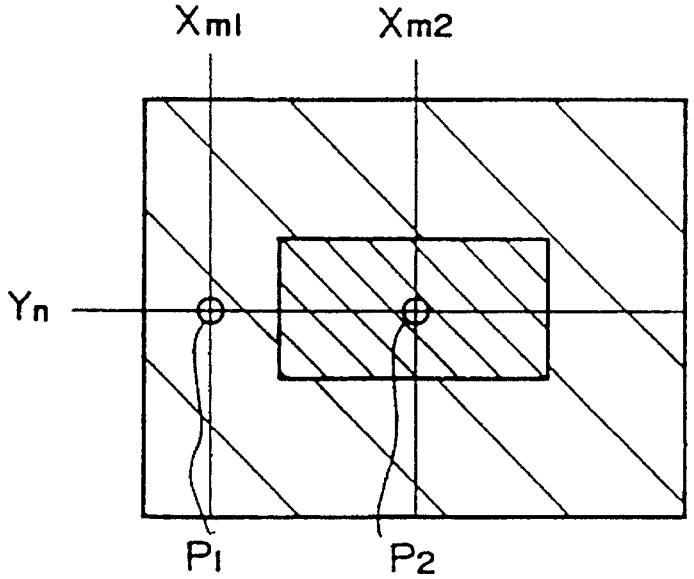
Fig. 10 PRIOR ART
FIG. 10 is a schematic view further showing the principle of occurrence of the afterimage.
Figure 11:
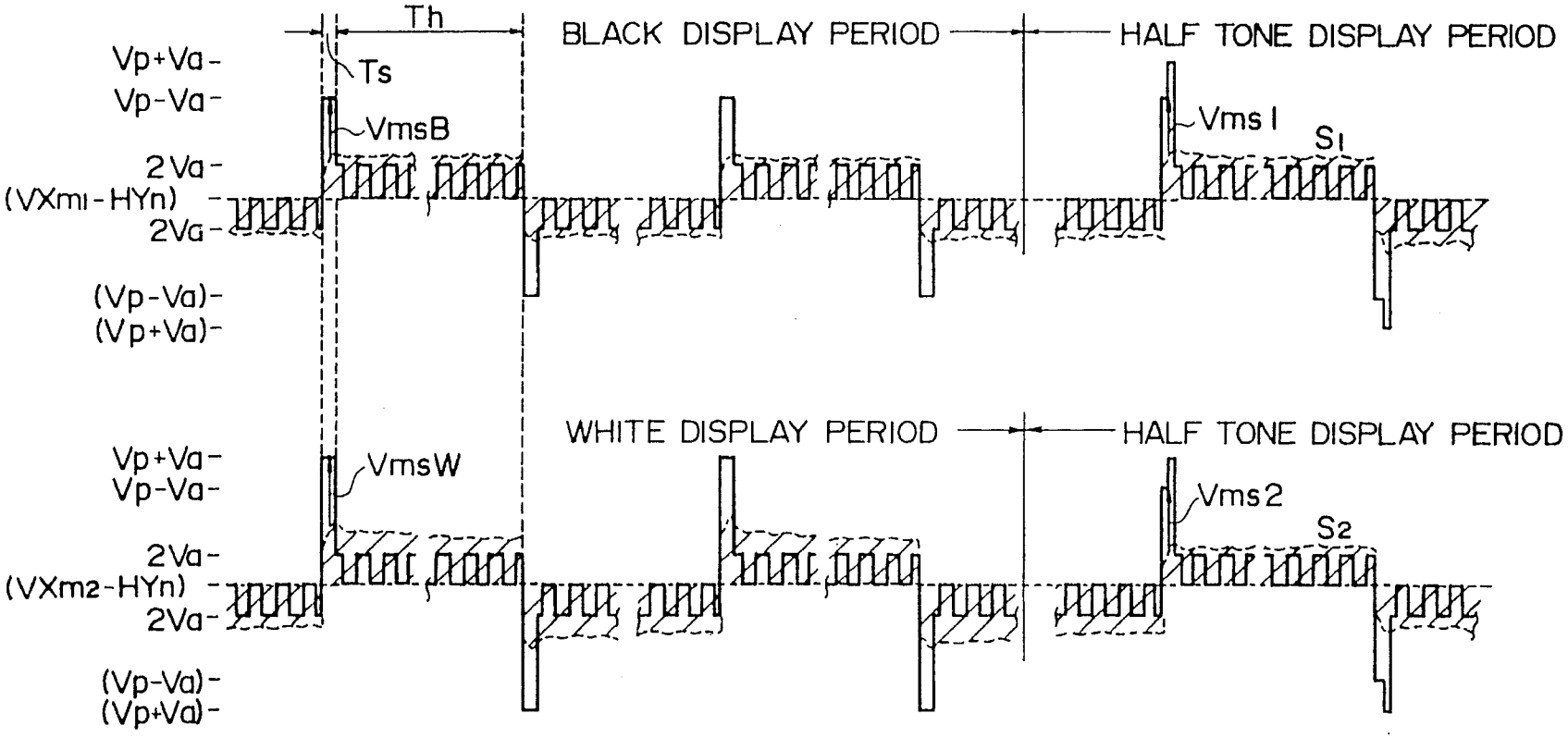
Fig. 11 PRIOR ART
FIG. 11 is a timing chart further showing the principle of occurrence of the afterimage.

Here, the period $\tau_H$ for which the a.c. inversion signal FR has the logical value "H" (hereinafter referred to as "positive-polarity period") and the period $\tau_L$ for which the a.c. inversion signal FR has the logical value "L" (hereinafter referred to as "negative-polarity period") are set in accordance with the following condition. That is, in a case where the I-V characteristic of the two-terminal active element as shown in FIG. 5, for example, has a non-linear characteristic providing a large current flow I with an applied voltage at the positive polarity region thereof, and inversely has a non-linear characteristic providing a small current flow I with the applied voltage at the negative polarity thereof, the positive-polarity period $\tau_H$ for the positive polarity of the a.c. inversion FR is set to a small value because of its inverse characteristic to the I-V characteristic, and the negative-polarity period $\tau_L$ for the negative polarity of the a.c. inversion signal FR is set to a large value because of its inverse characteristic to the I-V characteristic.

On the other hand, in a case where the I-V characteristic of the two-terminal active element, for example, has a non-linear characteristic providing a large current flow I with an applied voltage at the negative polarity region thereof, and inversely has a non-linear characteristic providing a small current flow I with the applied voltage at the positive polarity region thereof, the positive-polarity period $\tau_H$ for the positive polarity of the a.c. inversion FR is set to a large value because of its inverse characteristic to the I-V characteristic, and the negative-polarity period $\tau_L$ for the negative polarity of the a.c. inversion signal FR is set to a small value because of its inverse characteristic to the I-V characteristic.

That is, the positive-polarity and negative-polarity periods $\tau_H$ and $\tau_L$ of the a.c. inversion signal FR are set so as to have an inverse characteristic or relation to the I-V characteristic of the two-terminal active element. The setting of the positive-polarity and negative-polarity periods are carried out, for example, on the basis of a measurement result of electrical characteristics obtained in a process of manufacturing a liquid crystal panel.

The shift start signal DY is input to the Y shift register 302 as shown in FIG. 1, and shifted in synchronism with the shift clock signal $Y_{SCL}$ serving to set a period of the horizontal scanning operation to successively output the selection signals $C_1$ through $C_n$ to $C_N$ from the Y shift register 302 in synchronism with the shift clock signal $Y_{SCL}$.

However, with the shift clock signal $Y_{SCL}$ of this embodiment, the periods of the logical values "H" and "L" are different from each other every period of the shift clock signal, and thus a time width for which each of the selection signals $C_1$ through $C_n$ to $C_N$ has the logical value "H" is varied in accordance with the variation of the shift clock signal $Y_{SCL}$.

The latch pulse signal applied to the X-drive circuit 200 as shown in FIG. 1 is a pulse signal which has a logical value "H" in synchronism with a trailing edge of the shift clock signal $Y_{SCL}$. Therefore, the generation timing of the latch pulse signal LP is also varied in accordance with the shift clock signal $Y_{SCL}$.

Further, the shift start signal DX applied to the X shift register 202 as shown in FIG. 1 is a pulse signal which has a logical value "H" at the starting position of the video signal of each horizontal scanning period.

An enlarged view of a timing chart for one-horizontal scanning period (n+1) is shown at the lower side of FIG. 12. In FIG. 12, the shift start signal Dx is shifted by the X shift register 202 as shown in FIG. 1 which is actuated in synchronism with the shift clock signal $X_{SCL}$, and the sampling signals $S_1$ through $S_m$ to $S_M$ are generated in synchronism with the shift clock signal $X_{SCL}$. Detailing representatively the operations of the latch circuit for the m-th column electrode $X_m$ and the driving circuit as shown in FIG. 1, for example, after the a.c. video signal $P_S$ is held in the sample-and-hold capacitor 205 of the latch circuit in synchronism with the sampling signal $S_m$ within the n-th horizontal scanning period, the charges held in the sample-and-hold capacitor 205 is transferred to the sample-and-hold capacitor 207 in synchronism with the latch pulse signal LP within the (n+1)-th horizontal scanning period and the column electrode signal $VX_m$ having a voltage corresponding the held charges is outputted to the column electrode $X_m$. Therefore, an (n−1)-th a.c. video signal Ps is outputted as an n-th column electrode signal $VX_m$, and a (n+1)-th a.c. video signal Ps is outputted as an (n+2)-th column electrode signal $VX_m$. That is, the timing for sampling the a.c. video signal and the timing for outputting the column electrode signal $VX_m$ to the column electrode $X_m$ are deviated from each other by one horizontal scanning period.

In addition, since an interval between the successive latch pulse signals LP is varied, the time interval of the column electrode signal $VX_m$ is also varied in accordance with the variation of the interval of the latch pulse signal LP.

Figure 13:
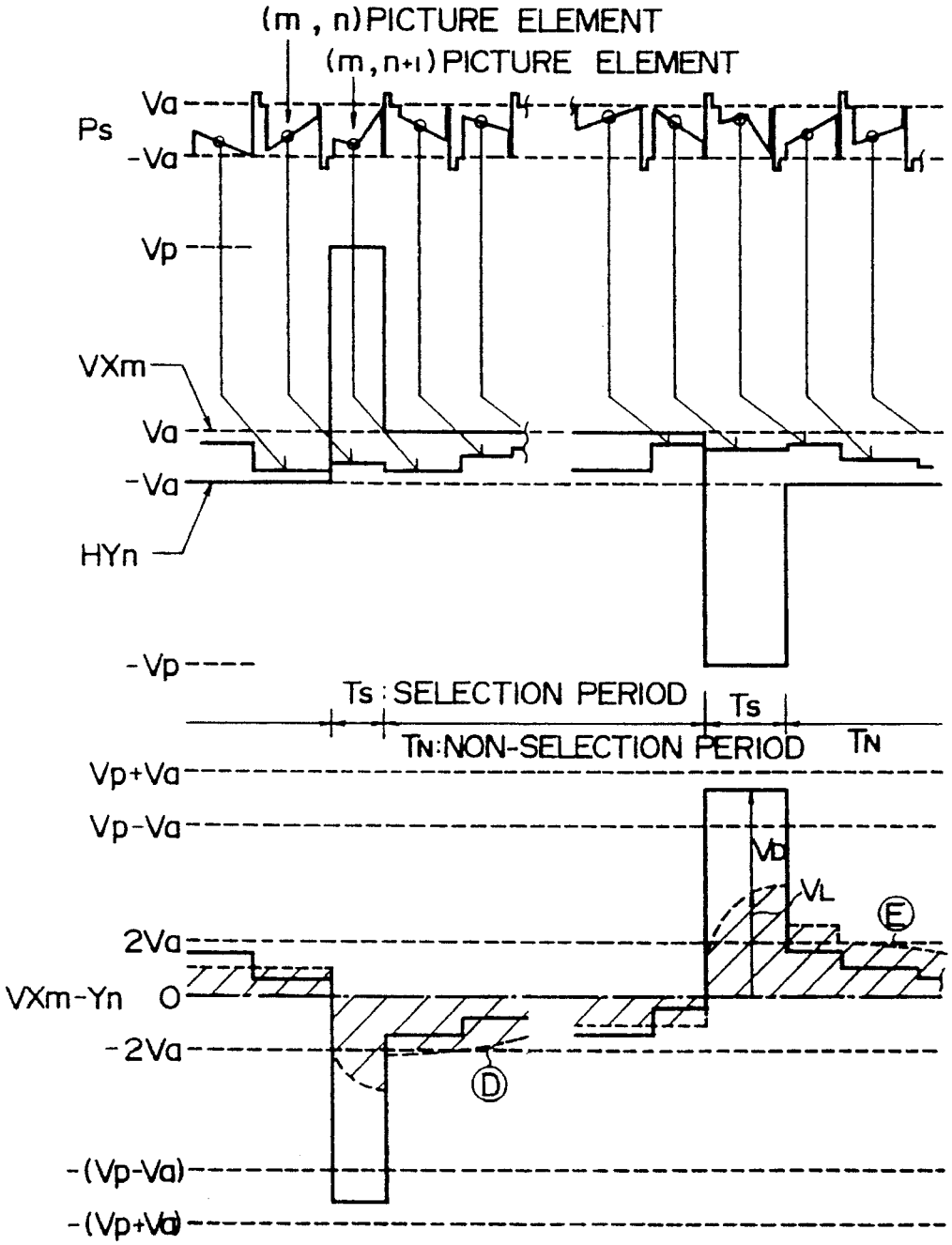
FIG. 13 is a timing chart further showing the driving method of the first embodiment.

FIG. 13 representatively shows timing charts for the column electrode signal $VX_m$, the row electrode signal $HY_n$ and the difference signals ($VX_m$–$HY_n$) thereof when a picture element (m, n) on the liquid crystal panel 100 as shown in FIG. 1 is selected.

The row electrode signal $HY_N$ supplied to the row electrode Yn for compensating the I-V characteristics of the two-terminal active element is set so that when the row electrode signal $HY_N$ is in positive polarity, the pulse width of the signal $HY_N$ corresponds to the period $\tau H$ when the a.c. inversion signal FR (see FIG. 12) is in the positive polarity, and when the signal $HY_N$ is in negative polarity, the pulse width of the signal $HY_N$ corresponds to the period $\tau L$ ($>\tau H$) when the a.c. inversion signal FR is in negative polarity. Accordingly, in this embodiment, the pulse width (in the selection period Ts) of the signal $HY_N$ when the signal $HY_N$ is in positive polarity, is narrow than when the signal $HY_N$ is in negative polarity. The absolute values in the amplitudes of them are equal to each other, that is, $|Vp|=|-Vp|$. Further the amplitude ($|Vp|$ and $|-Vp|$) in voltage of the signal $HY_N$ is set to be larger than the maximum amplitude in voltage of the column electrode signal $VX_M$ corresponding to the video signal Ps. As a result, the polarity of the difference signal ($VX_M-HY_N$) applied for compensating the I-V characteristics of the two-terminal active element is inverted to that of the signal $HY_N$ as shown in FIG. 13. That is, when the signal $HY_N$ is in positive polarity, the difference signal is in negative polarity, and when the signal $HY_N$ is in negative polarity, the difference signal is in positive polarity. Therefore, even if the two-terminal active element corresponding to the picture element (m, n) has an asymmetrical I-V characteristic between the positive and negative polarities thereof as shown in FIG. 5, the time width of the difference signal ($VX_m-HY_n$) for each selection period $T_S$ is set so as to have an inverse relation to the I-V characteristic of the two-terminal active element, and thus the effective voltage to be applied to the two-terminal active element (the effective voltages at the respective polarity regions are represented by dotted lines D and E, respectively) is equalized at both of the positive and negative polarity regions. Therefore, the voltage applied the liquid crystal layer of the picture element (m, n) is equalized at the positive and negative polarity regions, so that occurrence of the flicker can be greatly depressed.

According to this embodiment, the periods $\tau_H$ and $\tau_L$ for the positive and negative polarities of the a.c. inversion signal FR are set so as to have an inverse characteristic to the I-V characteristic of the two-terminal active element, whereby the two-terminal active element and the liquid crystal layer serving as a picture element are supplied with a difference signal of voltage having an inverse relation or characteristic to the I-V characteristic of the two-terminal active element. Therefore, even if the I-V characteristic of the two-terminal active element has an asymmetrical one between the positive and negative polarity regions thereof, the asymmetry of the I-V characteristic can be counteracted or compensated by the difference signal having the inverse characteristic to the I-V characteristic, so that the occurrence of an offset d.c. voltage can be prevented to depress the occurrence of flicker and prevent deterioration of the liquid crystal panel with time lapse.

A second embodiment of the driving method according to this invention will be next described with reference to FIGS. 14 through 19. The second embodiment has been implemented in view of the degradation of display quality due to the shift characteristic in which the I-V characteristic of the two-terminal active element is shifted in accordance with a voltage to be applied to the two-terminal active element (the second problem), and can prevent occurrence of the after-image phenomenon by compensating the shift characteristic of the two-terminal active element in a display operation of the liquid crystal panel of the liquid crystal display device.

The construction of the active matrix type liquid crystal display device to which the second embodiment of this invention is applied will be described with reference to FIG. 14.

The liquid crystal display device is equipped with a liquid crystal panel 400, an X-drive circuit 500 and a Y-drive circuit 600, and performs a display operation through a line-sequential scanning of each picture element of the liquid crystal panel 400 by the X-drive circuit 500 and the Y-drive circuit 600. The liquid crystal panel 400 includes a set of plural column electrodes $X_1$ through $X_m$ to $X_M$ (in figure, a m-th column electrode $X_m$ is representatively represented) which are connected to the X-drive circuit 500, another set of plural row electrodes $Y_1$ through $Y_n$ to $Y_N$ (in figure, n-th row electrode $Y_n$ is representatively represented) which are connected to the Y-drive circuit 600, the set of column electrodes and the set of row electrodes being provided on respective facing substrates so as to be intersected to each other, liquid crystal filled in a space between the column electrodes $X_1$ through $X_m$ to $X_M$ and the row electrodes $Y_1$ through $Y_n$ to $Y_N$, and two-terminal active elements each provided at each intersecting portion (picture element portion) between the column electrode and the row electrode). That is, representatively giving attention to the column electrode $X_m$ and the row electrode $X_n$, a liquid crystal layer 401 serving as a picture element and a two-terminal type active element 402 are connected in series between the column electrode $X_m$ and the row electrode $Y_n$, and both of a voltage $V_1$ to be applied to the liquid crystal layer 401 and a voltage $V_m$ to be applied to the two-terminal active element 402 are determined in accordance with a difference signal ($VX_m-HY_n$) to be applied between the electrodes $X_m$ and $Y_n$.

The X-drive circuit 500 is equipped with an X shift register 501 having output contact points of M for the column electrodes $X_1$ through $X_m$ to $X_M$, a set of latch circuits (in figure, the latch circuit 502 for the m-th column electrode $X_m$ is representatively shown), and a set of column electrode driving circuits (in figure, the column electrode driving circuit 503 for the m-th column electrode $X_m$ is representatively shown), these sets being provided between these output contact points and the set of the column electrodes $X_1$ through $X_m$ to $X_M$.

An A/D converter 700 receives the video signal P, and converts it to an N-bit digital video data in which the maximum gradation is represented by ($2^N-1$). The converted digital video data is supplied to the X shift register 501. The X shift register 501 is supplied with the digital video data in synchronism with the shift clock signal $X_{SCL}$ of predetermined frequency $f_x$, and is equipped with an M-stage shift register for performing a parallel shifting operation every N bits, thereby successively outputting digital video data $D_1$ through $D_m$ to $D_M$ from the output contact points in synchronism with the shift clock signal $X_{SCL}$.

A set of latch circuits and a set of driving circuits are provided between the column electrodes $X_1$ through $X_m$ to $X_M$ and the output contacts of the X shift register 501.

The following description is made representatively for a latch circuit 502 and a driving circuit 503 for the m-th column electrode $X_m$. The latch circuit 502 latches a digital video data $D_m$ outputted from the X shift register 501 in synchronism with an output timing. Thereafter, the driving circuit 503 carries out a pulse-width modulation processing to output to the column electrode $X_m$ a column electrode signal $VX_m$ having a time width which is proportional to a gradation set or represented by the digital video data $D_m$.

Figure 15:
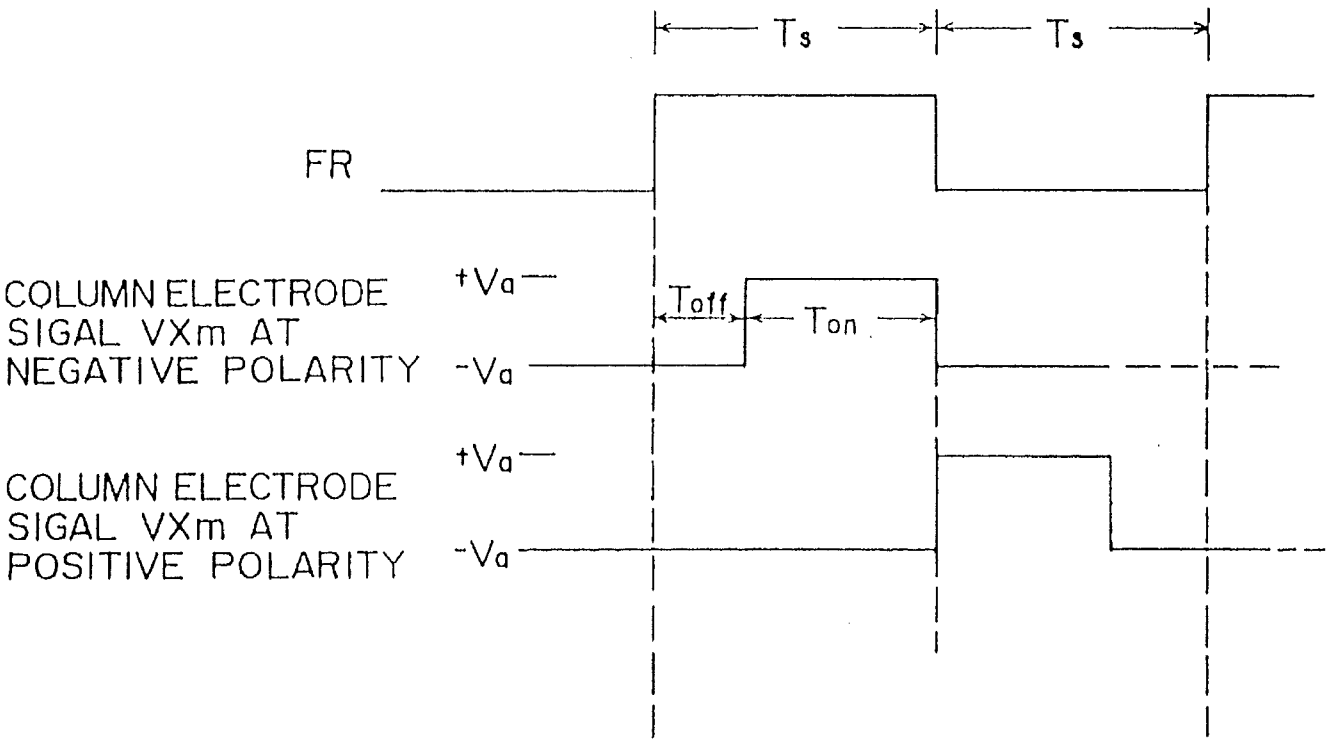
FIG. 15 is a waveform diagram showing the principle of a pulse width modulation in the active matrix type liquid crystal display device to which the second embodiment is applied.

The relationship between the voltage amplitude and the time width of the column electrode signal $VX_m$ for the digital video data $D_m$ will be described in more detail with reference to FIG. 15. The a.c. inversion signal FR is formed of a rectangular waveform having 50% duty factor and each half period thereof corresponds to one horizontal scanning period, so that the a.c. inversion signal FR serves to set the selection period $T_S$ for which the row electrodes $Y_1$ to $Y_N$ are successively selected at the timing of the line-sequential scanning operation. A selection period for negative polarity (negative-polarity selection period) $T_S$ is set up when the a.c. inversion signal FR has the logical value "H", while a selection period for positive polarity (positive-polarity selection period) $T_S$ is set up when the a.c. inversion signal FR has the logical value "L". In addition, the maximum gradation $(2^N-1)$ of the digital video data $D_m$ is set to be equal to the time width of the half period (i.e., $T_S$) of the a.c. inversion signal FR, and the pulse width modulation (PWM modulation) is carried out within this time width. Further, when the a.c. inversion signal FR has the logical value "H", the column electrode signal $VX_m$ is set to $V_a$ for the time width $V_{on}$ which is proportional to the digital video data $D_m$, and is set to $-V_a$ for the residual time width $V_{off}$. When the a.c. inversion signal FR has the logical value "L", the column electrode signal $VX_m$ is set to $-V_a$ for an selection time width $V_{on}$ corresponding to the digital video data $D_m$ and is set to $V_a$ for the residual time width $V_{off}$.

When the column electrode signal $VX_m$ which has been subjected to the pulse width modulation is applied to the column electrode $X_m$ in the manner as described above, an effective voltage to be applied to the liquid crystal layer located at an intersecting position between the column electrode $X_m$ and the row electrode corresponds to the product of the time width and a constant amplitude $|V_a|$. This is equivalent to an operation of applying to the column electrode $X_m$ a column electrode signal whose voltage corresponds to the digital video data $D_m$.

A liquid crystal power generating circuit 601 in the Y-drive circuit 600 is supplied with six kinds of voltages $V_r$, $V_p$, $V_a$, $-V_r$, $-V_p$, $-V_a$ whose absolute values satisfy the following inequality: $|V_r| \geqq |V_p| \geqq |V_a|$, and it carries out a multiplexing operation in synchronism with the a.c. inversion signal FR to output three kinds of liquid crystal $V_R$, $V_S$ and $V_N$ to transmission lines 602, 603 and 604.

The Y shift register 605 shifts the Y shift start signal DY in synchronism with the shift clock signal $Y_{SCL}$ of predetermined frequency $f_Y$ to successively output the selection signals $C_1$ through $C_n$ to $C_N$ from the output contact points of N.

A set of switching circuits are provided between the respective output contact points of the Y shift register 605 and the row electrodes $Y_1$ through $Y_n$ to $Y_N$. The following description is made representatively for a switching circuit for an n-th row electrode $Y_n$. The switching circuit includes an AND gate 606 for obtaining a logical product between a selection signal $C_n$ outputted from an n-th output contact point of the Y shift register 605 and a selection signal $C_{n-1}$ outputted from an (n−1)-th output contact point which is located just prior to the n-th output contact point, an AND gate 606 for obtaining a logical product between the selection signal $C_n$ outputted from the n-th output contact point and a logically-inverted signal of the selection signal $C_{n-1}$ outputted from the (n−1)-th output contact point which is located just prior to the n-th output contact point, an analog switch 608 which is provided between the transmission line 602 and the row electrode $Y_n$ and switched between conducting and non-conducting states in accordance with the logical output of the AND gate 606, an analog switch 609 which is provided between the transmission line 603 and the row electrode $Y_n$ and switched between conducting and non-conducting states in accordance with the logical output of the AND gate 607, and an analog switch 610 which is provided between the transmission line 604 and the row electrode $Y_n$ and switched between the conducting and non-conducting states in accordance with the inverted logical signal of the selection signal $C_n$.

Therefore, when both of the selection signals $C_{n-1}$ and $C_n$ have logical values "H", the liquid crystal voltage $V_R$ is applied to the row electrode $Y_n$, and when the selection signals $C_{n-1}$ and $C_n$ have logical values "L" and "H", respectively, the liquid crystal voltage $V_S$ is applied to the row electrode $Y_n$. Further, when the selection signal $C_n$ has a logical value "L", the liquid crystal voltage $V_N$ is applied to the row electrode $Y_n$ irrespective of the logical value of the selection signal $C_{n-1}$.

Further, in consideration of the relation to the logical value of the a.c. inversion signal FR, when all of the a.c. inversion signal FR and the selection signals $C_{n-1}$ and $C_n$ have the logical value "H", a selection voltage $+V_r$ is applied to the row electrode $Y_n$, and when the a.c. inversion signal Fr has the logical value "L", and both of the selection signals $C_{n-1}$ and $C_n$ have the logical value "H", the selection voltage $-V_r$ is applied to the row electrode $Y_n$. Further, when the a.c. inversion signal FR has the logical value "H", the selection signal $C_{n-1}$ has the logical value "L", and the selection signal $C_n$ has the logical value "H", the selection voltage $+V_P$ is applied to the row electrode $Y_n$, and when the a.c. inversion signal FR has the logical value "L", the selection signal $C_{n-1}$ has the logical value "L", and the selection signal $C_n$ has the logical value "H", the selection voltage $-V_P$ is applied to the row electrode $Y_n$.

Figure 17:
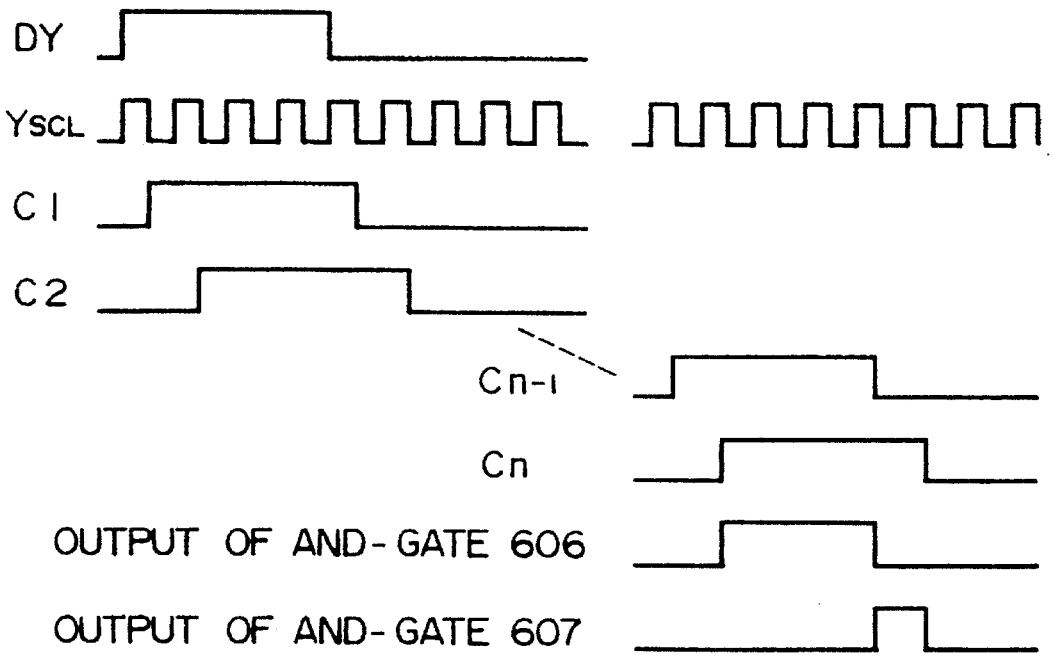
FIG. 17 is a timing chart showing the driving method of the second embodiment.

The operation of the active matrix type liquid crystal display device thus constructed will be described with reference to FIGS. 17 to 19. In this embodiment, as shown in FIG. 17, the time width of the shift start signal DY is set to a period corresponding to four periods of the shift clock signal $Y_{SCL}$. the shift start signal DY is successively shifted in synchronism with the trailing edge of the shift clock signal $Y_{SCL}$ in the Y shift register 805 to thereby generate selection signals $C_1$ to $C_N$ which have the same time width as the shift start signal DY and are deviated from one another by one period of the shift clock signal $Y_{SCL}$.

Figure 18:
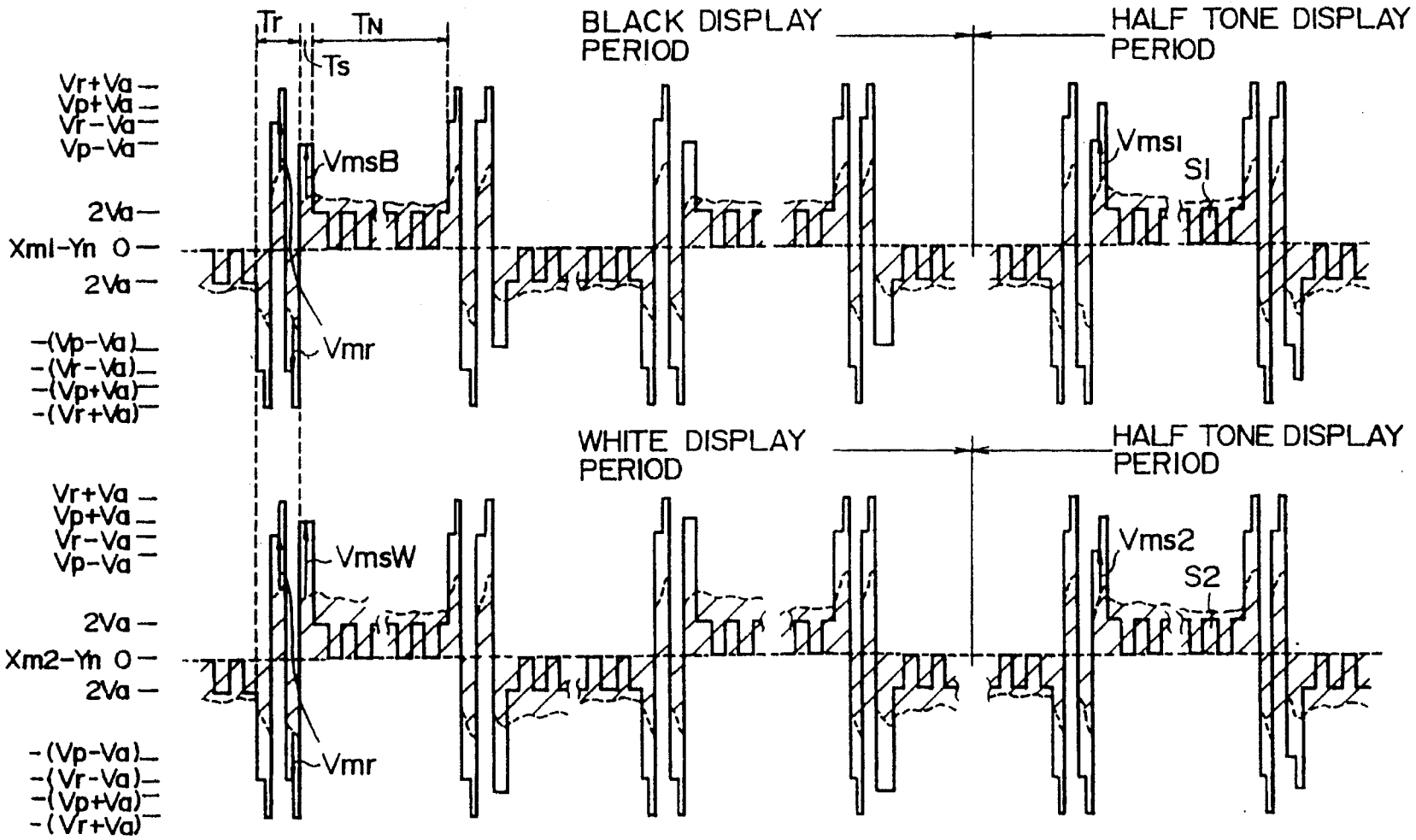
FIG. 18 is a timing chart further showing the driving method of the second embodiment.

In association with the generation of these selection signals $C_1$ to $C_N$, a difference signal to be applied to each of m1-th and m2-th column electrodes $X_{m1}$ and $X_{m2}$ for an n-th row electrode $Y_n$ has a waveform as shown in FIG. 18.

The timing chart as shown in FIG. 18 will be further described. The generation timing of the selection signals $C_{n-1}$ and $C_n$ are deviated from each other by one horizontal period as described above, a period $T_r$ for which the logical values of both of the selection signals $C_{n-1}$ and $C_n$ are "H" is three times of the horizontal scanning period (3H). Within the period $T_r$ (hereinafter referred to as "reset period"), as shown in FIG. 18, the electrodes are supplied with a larger voltage than the maximum-amplitude voltage used for an ordinary display operation (the maximum amplitude voltage is equal to $V_p+V_a$ for black at the positive polarity, and is equal to—$(V_p+V_a)$ for black at the negative polarity. A next one-horizontal period subsequent to the reset period $T_r$ corresponds to an ordinary selection period $T_s$, and the column electrode signal $VX_m$ outputted from the X-drive circuit 500 is supplied to the column electrode $X_m$. When the selection period $T_s$ is completed, a next scanning operation of the row electrode is started, and thus this period is a non-selection period $T_N$ for the row electrode $Y_n$. This non-selection period $T_N$ is continued until one-field scanning period or one-frame scanning period elapses. Thereafter, upon completion of the one-field or one-frame scanning period, the non-selection period $T_N$ is transferred to the reset period $T_r$ and the selection period $T_S$, and these processings are repeated. The same processings are conducted on the other scanning operations of the other column electrodes $C_1$ to $C_{n+1}$ and $C_{n+1}$ to $C_N$.

Further, the polarity of the voltage to be applied to each of the column electrodes $c_1$ to $C_N$ is inverted every one-field or one-frame scanning period.

As shown in FIG. 18, a picture element at an intersecting portion (m1, n) between the m1-th column electrode $X_{m1}$ and the n-th row electrode $Y_n$ is supplied with a difference signal ($VX_{m1}-HY_n$) having an absolute value $|V_p-V_a|$ for each selection period $T_S$ within a black display period, whereby the liquid crystal panel is displayed black. On the other hand, a picture element at an intersecting portion (m2, n) between the m2-th column electrode $X_{m1}$ and the n-th row electrode $Y_n$ is supplied with a difference signal ($VX_{m2}-HY_n$) having an absolute value $|V_p+V_a|$ for each selection period $T_S$ within a white display period (having the same period as the black display period), whereby the liquid crystal panel is displayed white. The picture elements (m1,n) and (m2,n) are switched from the above display states to a half tone display state for a half tone display period.

If the driving method of this embodiment is not applied, as described above, through the switching operation to the half tone display state, the difference signal ($VX_{m1}-HY_n$) applied to the picture element at the intersecting portion between the column electrode $X_{m1}$ and the row electrode $Y_n$ is equal to the difference signal ($VX_{m2}-HY_n$) applied to the picture element at the intersecting portion between the column electrode $X_{m2}$ and the row electrode $Y_n$, however, the effective voltages $V_{ms1}$ and $V_{ms2}$ applied to the liquid crystal layer, and the effective values S1 and S2 are respectively different from each other as shown in FIG. 18 due to the difference in shift characteristic which is caused by the white and black display operations. This difference in shift characteristic causes an afterimage. The following description is the principle of greatly depressing the afterimage phenomenon by applying a difference signal of large voltage in the reset period $T_r$ just before the ordinary selection period $T_S$. The cause of occurrence of the afterimage resides in that there is a difference in shift amount of electrical characteristic between two-terminal active elements used for the picture elements which are carrying out white and black display operations, respectively, and thus the effective voltages to be applied to the liquid crystal layer are different between these two-terminal active elements due to the difference of the characteristics thereof even when both of the two-terminal active elements are driven to carry out the same half tone display operation.

On the other hand, in this embodiment, a difference signal having high voltage is applied to a two-terminal active element for the reset period $T_r$ to thereby saturate the I-V shift characteristic of the two-terminal active element with the high voltage and hold the I-V shift characteristic, so that the I-V characteristic of the two-terminal active element is not fluctuated since then. As a result, even when a display operation which provides a difference between shift amounts (for example, a window having white and black portions as described above) is carried out and then is switched to a half tone display operation, the two-terminal active element carries out a display operation on the basis of the stabilized I-V shift characteristic which has been subjected to the above saturation treatment with the high voltage, so that the occurrence of the afterimage phenomenon which has been conventionally caused due to the shift characteristic can be greatly depressed.

The depression of the afterimage phenomenon will be further described with reference to FIG. 19, which is an enlarged view of the timing chart within the half tone display period as shown in FIG. 18. FIG. 19 shows representatively the column electrode signal $VX_m$ and the row electrode signal $HY_n$ which are applied to the m-th column electrode $X_m$ and the n-th row electrode $Y_n$ respectively, and the difference signal ($VX_m-HY_n$). In FIG. 19, a waveform indicated by a solid line represents an actually-applied voltage, and a waveform indicated by a dotted line represents an effective voltage. Further, the voltage $V_{ms1}$ of the difference signal ($VX_m-HY_n$) and the effective voltage $V_{mn1}$ are voltages before one-field or one-frame period, and the voltage $V_{ms2}$ of the difference signal ($VX_m-HY_n$) and the effective voltage $V_{mn2}$ are voltages after one-field or one-frame period. Further, the voltages $V_{ms1}$, $V_{ls1}$, $V_{mn1}$ and S1 represent voltages which are applied to the liquid crystal layer and the two-terminal active element for the half tone display state after the black display period, and the voltages $V_{ms2}$, $V_{ls2}$, $V_{mn2}$ and S2 are voltages which are applied to the liquid crystal layer and the two-terminal active element for the half tone display state after the white display period, these voltages being superposedly shown on the same time axis.

Figure 19:
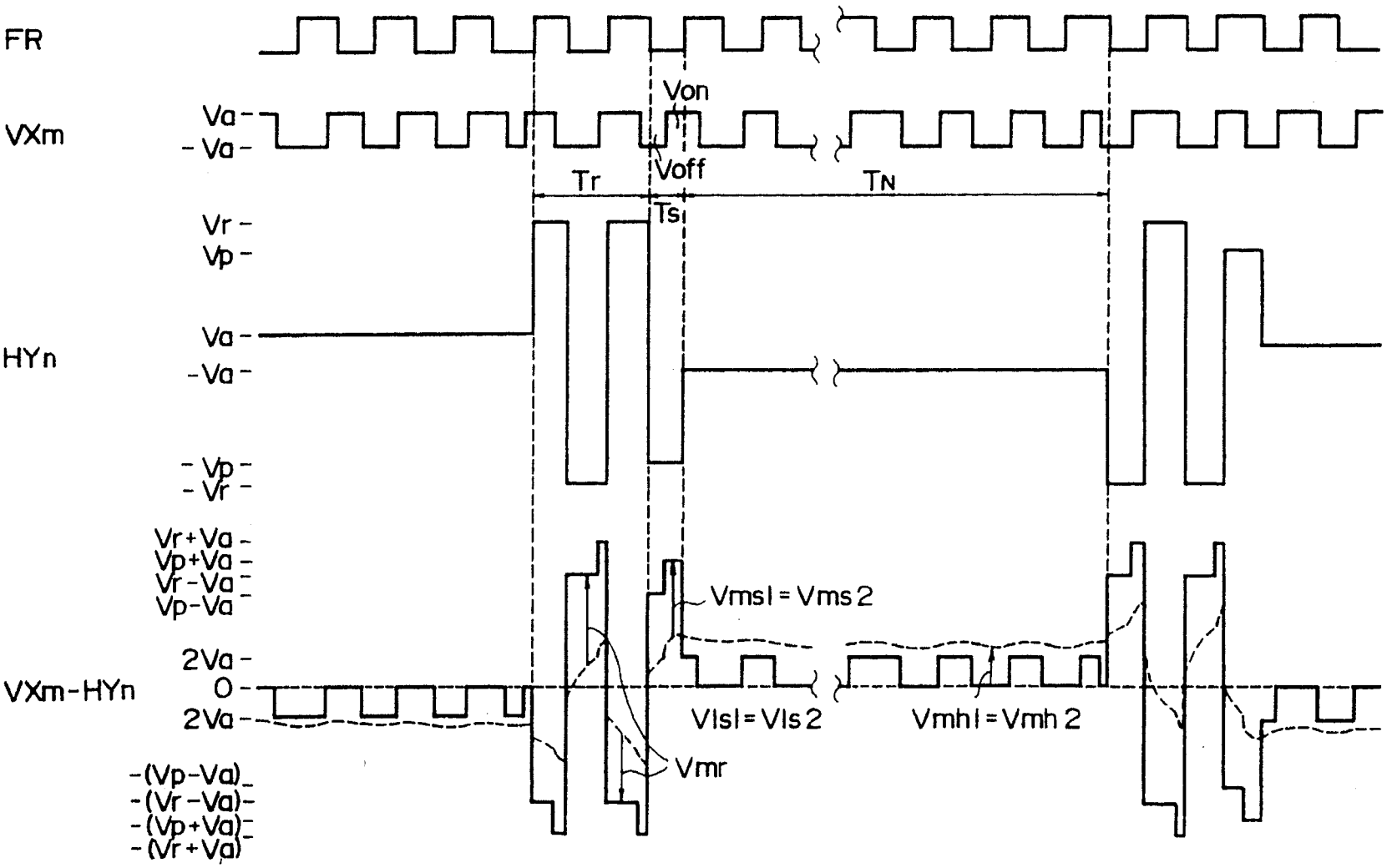
FIG. 19 is a timing chart further showing the driving method of the second embodiment.

Apparently from FIG. 19, when a black or white pattern is first displayed and then the display is switched to the same half tone level, the difference signal applied for the selection period $T_S$ is equal between both cases, and thus $V_{ms1}=V_{ms2}$, so that the effective voltages also satisfy the following equation: $V_{ls1}=V_{ls2}$. Further, the effective voltages applied for the non-selection period $T_N$ satisfy the following equations: $V_{mn1}=V_{mn2}$, and S1=S2. Therefore, as described above, the occurrence of the afterimage phenomenon due to the shift characteristic of the two-terminal active element can be depressed.

In addition, the reset period $T_r$ is circulatingly provided to each of the row electrodes $Y_1$ to $Y_N$ every one-field or one-frame period, and thus the reset period $T_r$ every three horizontal scanning periods (3H) merely corresponds to a period of several % of the one-field or one-frame period. Accordingly, the fluctuation of the voltage applied to the liquid crystal layer is remarkably slight even when the high voltage is applied to the liquid crystal layer for the reset period $T_r$ according to the driving method of this embodiment, and thus the application of the high voltage to the liquid crystal layer never causes the degradation of display quality.

In this embodiment, the reset period $T_r$ is set to three-horizontal scanning period. However, the reset period $T_r$ is not necessarily limited to this value, and may be set to a period longer than the above period insofar as the degradation of display quality due to the voltage fluctuation is not induced. Further, the reset period $T_r$ may be shorter than that of this embodiment by increasing the applied voltage in the reset period $T_r$. In this case, it is needless to say that the maximum value of the voltage must be set to such a value that the liquid crystal layer and the two-terminal active element are not damaged.

A third embodiment of this invention will be next described with reference to FIGS. 20 through 23. Like the second embodiment, this embodiment has been implemented in view of the problem of the degradation of the display quality due to the shift characteristic that the I-V characteristic is shifted in accordance with the voltage applied to the two-terminal active element (the second problem), and can prevent the occurrence of the afterimage phenomenon by compensating for the shift characteristic of the two-terminal active element in the display operation of the liquid crystal panel of the liquid crystal display device.

Figure 20:
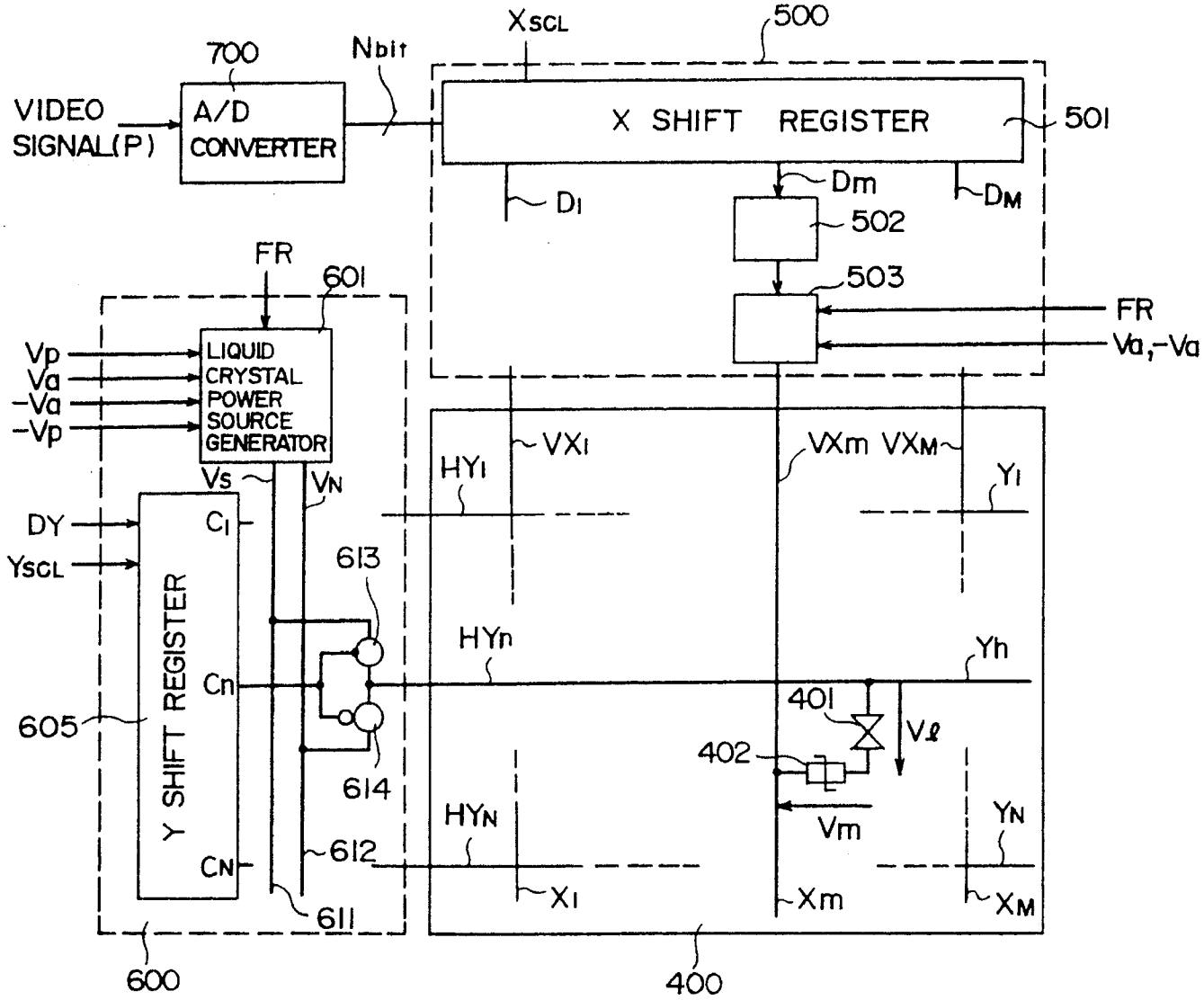
FIG. 20 is a block diagram showing the active matrix type liquid crystal display device to which a third embodiment of this invention is applied.

First, the construction of the active matrix type liquid crystal display device will be described with reference to FIG. 20. In FIG. 20, the same or substantially same portions as those of FIG. 14 are represented by the same reference numerals.

That is, the liquid crystal display device of this embodiment is equipped with the liquid crystal panel 400, the X-drive circuit 500 and the Y-drive circuit 600, and the display operation is carried out through the line-sequential scanning operation of the respective picture element portions of the liquid crystal panel 400 using the X-drive circuit 500 and the Y-drive circuit 600.

The liquid crystal panel 400 includes a set of plural column electrodes $X_1$ through $X_m$ to $X_M$ (in figure, a m-th column electrode $X_m$ is representatively represented) which are connected to the X-drive circuit 500, another set of plural row electrodes $Y_1$ through $Y_n$ to $Y_N$ (in figure, n-th row electrode $Y_n$ is representatively represented) which are connected to the Y-drive circuit 600, the set of column electrodes and the set of row electrodes being provided on respective facing substrates so as to be intersected to each other, liquid crystal filled in a space between the column electrodes $X_1$ through $X_m$ to $X_M$ and the row electrodes $Y_1$ through $Y_n$ to $Y_N$, and two-terminal active elements each provided at each intersecting portion (picture element portion) between the column electrode and the row electrode). That is, representatively giving attention to the column electrode $X_m$ and the row electrode $X_n$, a liquid crystal layer 401 serving as a picture element and a two-terminal type active element 402 are connected in series between the column electrode $X_m$ and the row electrode $Y_n$.

The X-drive circuit 500 is equipped with an X shift register 501 having output contact points of M for the column electrodes $X_1$ through $X_m$ to $X_M$, a set of latch circuits (in figure, the latch circuit 502 for the m-th column electrode $X_m$ is representatively shown), and a set of column electrode driving circuits (in figure, the column electrode driving circuit 503 for the m-th column electrode $X_m$ is representatively shown), these sets being provided between these output contact points and the set of the column electrodes $X_1$ through $X_m$ to $X_M$.

An A/D converter 700 receives the video signal P, and converts it to an N-bit digital video data in which the maximum gradation is represented by $(2^N-1)$. The converted digital video data is supplied to the X shift register 501. The X shift register 501 is supplied with the digital video data in synchronism with shift clock signal $X_{SCL}$ of predetermined frequency $f_x$, and is equipped with an M-stage shift register for performing a parallel shifting operation every N bits, thereby successively outputting digital video data $D_1$ through $D_m$ to $D_M$ from the output contact points in synchronism with the shift clock signal $X_{SCL}$.

A set of latch circuits and a set of driving circuits are provided between the column electrodes $X_1$ through $X_m$ to $X_M$ and the output contacts of the X shift register 501.

The following description is made representatively for a latch circuit 502 and a driving circuit 503 for the m-th column electrode $X_m$. The latch circuit 502 latches a digital video data $D_m$ outputted from the X shift register 501 in synchronism with an output timing. Thereafter, the driving circuit 503 carries out a pulse-width modulation processing to output to the column electrode $X_m$ a column electrode signal $VX_m$ having a time width which is proportional to a gradation set by the digital video data $D_m$. The pulsewidth modulation processing is carried out in accordance with the same principle as the second embodiment.

The liquid crystal power generating circuit 601 in the Y-drive circuit 600 are supplied with four kinds of voltages $V_p$, $V_a$, $-V_p$, $-V_a$ whose absolute values satisfy the following inequality: $|V_p| \geq |V_a|$, and it carries out a multiplexing operation in synchronism with the a.c. inversion signal FR to output two kinds of liquid crystal voltages $V_S$ and $V_N$ to the transmission lines 612 and 614. That is, when the a.c. inversion signal FR has a logical value "H", the liquid crystal voltages $V_p$ and $V_N$ become voltages $V_p$ and $V_a$, respectively, and when the a.c. inversion signal FR has a logical value "L", the liquid crystal voltages $V_S$ and $V_N$ become $-V_p$ and $-V_a$.

The Y shift register 605 shifts a Y shift start signal DY in synchronism with a shift clock signal $Y_{SCL}$ of predetermined frequency $f_Y$ to successively output selection signals $C_1$ through $C_n$ to $C_N$ from the output contact points of N.

A set of switching circuits are provided between the output contact points and the row electrodes $Y_1$ through $Y_n$ to $Y_N$. Describing representatively the switching circuit for the n-th row electrode $Y_n$ as shown in FIG. 20, the switching circuit includes a first analog switch 613 whose conducting and non-conducting states are switched in accordance with the selection signal $C_n$ outputted from the n-th output contact point of the Y shift register 605, and which is connected between the transmission line 611 and the row electrode $Y_n$, and a second switch whose conducting and non-conducting states are switched in accordance with an inversion signal of the selection signal $C_n$ and which is connected between the transmission line 612 and the row electrode $Y_n$. When the selection signal $C_n$ has a logical value "H", the liquid crystal voltage $V_n$ is supplied to the row electrode $Y_n$, and when the selection signal $C_n$ has a logical value "L", the liquid crystal voltage $V_N$ is supplied to the row electrode $Y_n$.

Figure 21:
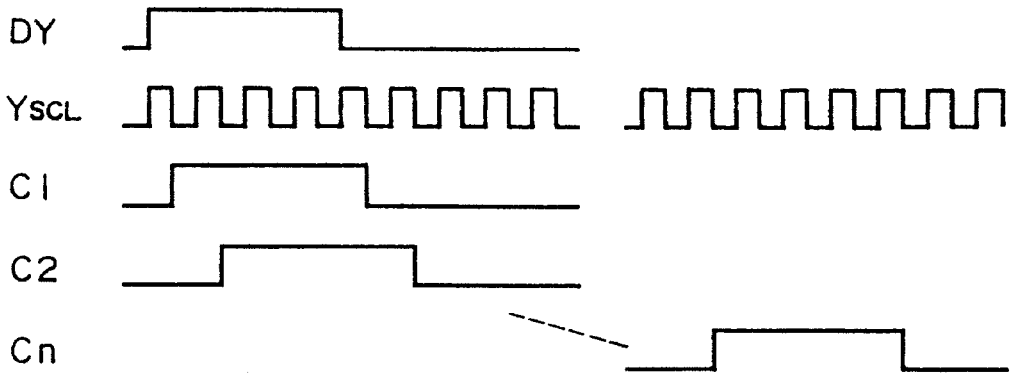
FIG. 21 is a timing chart showing the driving method of the third embodiment.

The operation of the active matrix type liquid crystal display device thus constructed will be described with reference to FIGS. 21 through 23. First, in this embodiment, the time width of the shift start signal DY is set to a value corresponding to four periods of the shift clock signal $Y_{SCL}$. The shift start signal DY is successively shifted in synchronism with the trailing edge of the shift clock signal $Y_{SCL}$, thereby generating the selection signals $C_1$ to $C_N$ which have the same time width as the shift start signal DY and are deviated from one another by one period of the shift clock signal $Y_{SCL}$.

Figure 22:
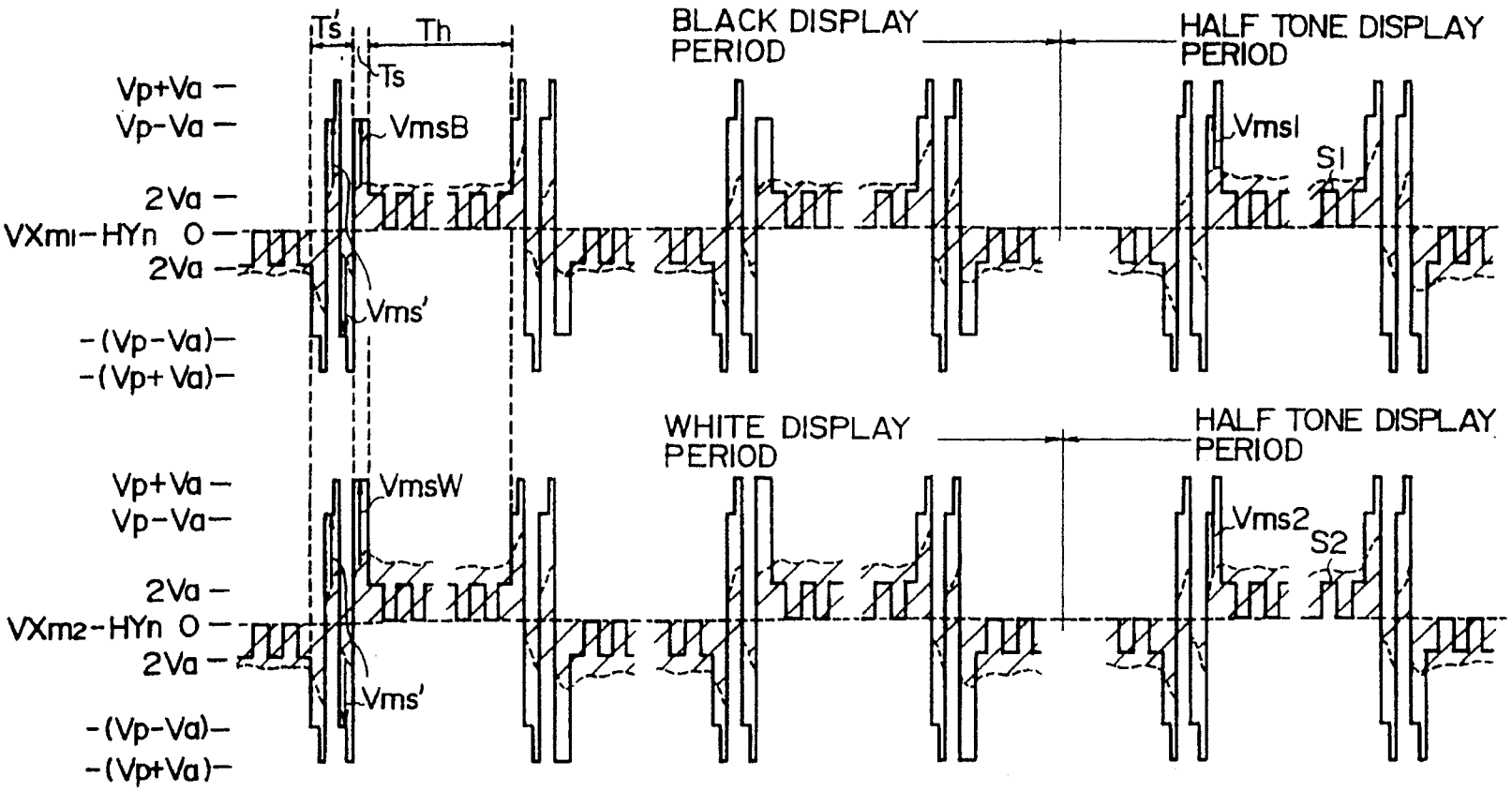
FIG. 22 is a timing chart further showing the driving method of the third embodiment.

Upon generation of these selection signals $C_1$ to $C_N$, for example, difference signals $(VX_{m1}-HY_n)$ and $(VX_{m2}-HY_n)$ which are applied to the m1-th and m2-th column electrodes $X_{m1}$ and $X_{m2}$ for the n-th row electrode, respectively, have waveforms as shown in FIG. 22.

Detailing the timing chart as shown in FIG. 22, since the generation timing of the selection signal $C_n$ is deviated by one horizontal scanning period as described above, a period $T_S$' for which the selection signal $C_n$ has the logical value "H" (hereinafter referred to as "reset period") is equal to three times of the horizontal scanning period (3H).

A period subsequent to the reset period $T_S$' corresponds to an ordinary selection period $T_S$, and the column electrode signal $VX_m$ outputted from the X-drive circuit 500 is supplied to the row electrode $X_m$. Further, when the selection period $T_S$ is completed, the scanning operation of the next row electrode is started, and this period is a non-selection period for the row electrode $Y_n$. The non-selection period $T_N$ is continued until one-field or one-frame scanning period elapses. Thereafter, the reset period $T_S$' and the selection period $T_S$ are returned again, and these processings are repeated. The same processings are repeated for the scanning operation of the other column electrodes $C_1$ to $C_{n-1}$ and $C_{n+1}$ to $C_N$.

In addition, the polarity of the voltage applied to each of the column electrodes $C_1$ to $C_N$ is inverted every one-field or one-frame scanning period.

FIG. 22 shows a situation where a picture element (m1,n) at the intersecting portion between the m1-th column electrode $X_{m1}$ and the n-th row electrode $Y_n$ is supplied with the difference signal ($VX_{m1}$–$HY_n$) having the voltage $|V_p-V_a|$ for each selection period $T_S$ within a black display period to be displayed black while a picture element (m2,n) at the intersecting portion between the m2-th column electrode $X_{m2}$ and the n-th row electrode $Y_n$ is supplied with the difference signal ($VX_{m2}$–$HY_n$) having the voltage $|V_p+V_a|$ for each selection period $T_S$ within a white display period (the same period as the black display period) to be displayed white, and then the display state is switched from the above display state to a half tone display state for a half tone display period. As shown in FIG. 22, the effective voltages of the difference signals ($VX_{m1}$–$HY_n$) and ($VX_{m2}$–$HY_n$) are equal to $V_{ms1}$ and $V_{ms2}$ respectively for the selection period $T_S$ within the half tone display period, and the effective voltages in the non-selection period $T_N$ are equal to S1 and S2.

If the driving method of this embodiment is not applied, as described above, through the switching operation to the half tone display state, the difference signal ($VX_{m1}$–$HY_n$) applied to the picture element at the intersecting portion between the column electrode $X_{m1}$ and the row electrode $Y_n$ is equal to the difference signal ($VX_{m2}$–$HY_n$) applied to the picture element at the intersecting portion between the column electrode $X_{m2}$ and the row electrode $Y_n$, however, the effective voltages $V_{ms1}$ and $V_{ms2}$ applied to the liquid crystal layer, and the effective values S1 and S2 are respectively different from each other as shown in FIG. 22 due to the difference in shift characteristic which is caused by the white and black display operations. This difference in shift characteristic causes an afterimage phenomenon. The following description is the principle of greatly depressing the afterimage phenomenon by applying a difference signal of large voltage in the reset period $T_r$ just before the ordinary selection period $T_S$. The cause of occurrence of the afterimage resides in that there is a difference in shift amount of electrical characteristic between two-terminal active elements used for the picture elements which are carrying out white and black display operations, respectively, and thus the effective voltages to be applied to the liquid crystal layer are different between these two-terminal active elements due to the difference of the characteristics thereof even when both of the two-terminal active elements are driven to carry out the same half tone display operation.

On the other hand, in this embodiment, a difference signal having high voltage is applied to a two-terminal active element for the reset period $T_r$ to thereby saturate the I-V shift characteristic of the two-terminal active element with the high voltage and hold the I-V shift characteristic, so that the I-V characteristic of the two-terminal active element is not fluctuated since then. As a result, even when a display operation which provides a difference between shift amounts (for example, a window having white and black portions as described above) is carried out and then is switched to a half tone display operation, the two-terminal active element carries out a display operation on the basis of the stabilized I-V characteristic, so that the occurrence of the afterimage phenomenon which has been conventionally caused due to the shift characteristic can be greatly depressed.

The depression of the afterimage phenomenon will be further described with reference to FIG. 23 which is an enlarged view of the timing chart within the half tone display period as shown in FIG. 22. FIG. 23 shows representatively the column electrode signal $VX_m$ and the row electrode signal $HY_n$ which are applied to the m-th column electrode $X_m$ and the n-th row electrode $Y_n$ respectively, and the difference signal ($VX_m$–$HY_n$). In FIG. 23, a waveform indicated by a solid line represents an actually-applied voltage, and a waveform indicated by a dotted line represents an effective voltage. Further, the voltage $V_{ms1}$ of the difference signal ($VX_m$–$HY_n$) and the effective voltage $V_{mn1}$ are voltages before one-field or one-frame period, and the voltage $V_{ms2}$ of the difference signal ($VX_m$–$HY_n$) and the effective voltage $V_{mn2}$ are voltages after one-field or one-frame period. Further, the voltages $V_{ms1}$, $V_{ls1}$, $V_{mn1}$ and S1 represent voltages which are applied to the liquid crystal layer and the two-terminal active element for the half tone display state after the black display period, and the voltages $V_{ms2}$, $V_{ls2}$, $V_{mn2}$ and S2 are voltages which are applied to the liquid crystal layer and the two-terminal active element for the half tone display state after the white display period, these voltages being superposedly shown on the same time axis.

Figure 23:
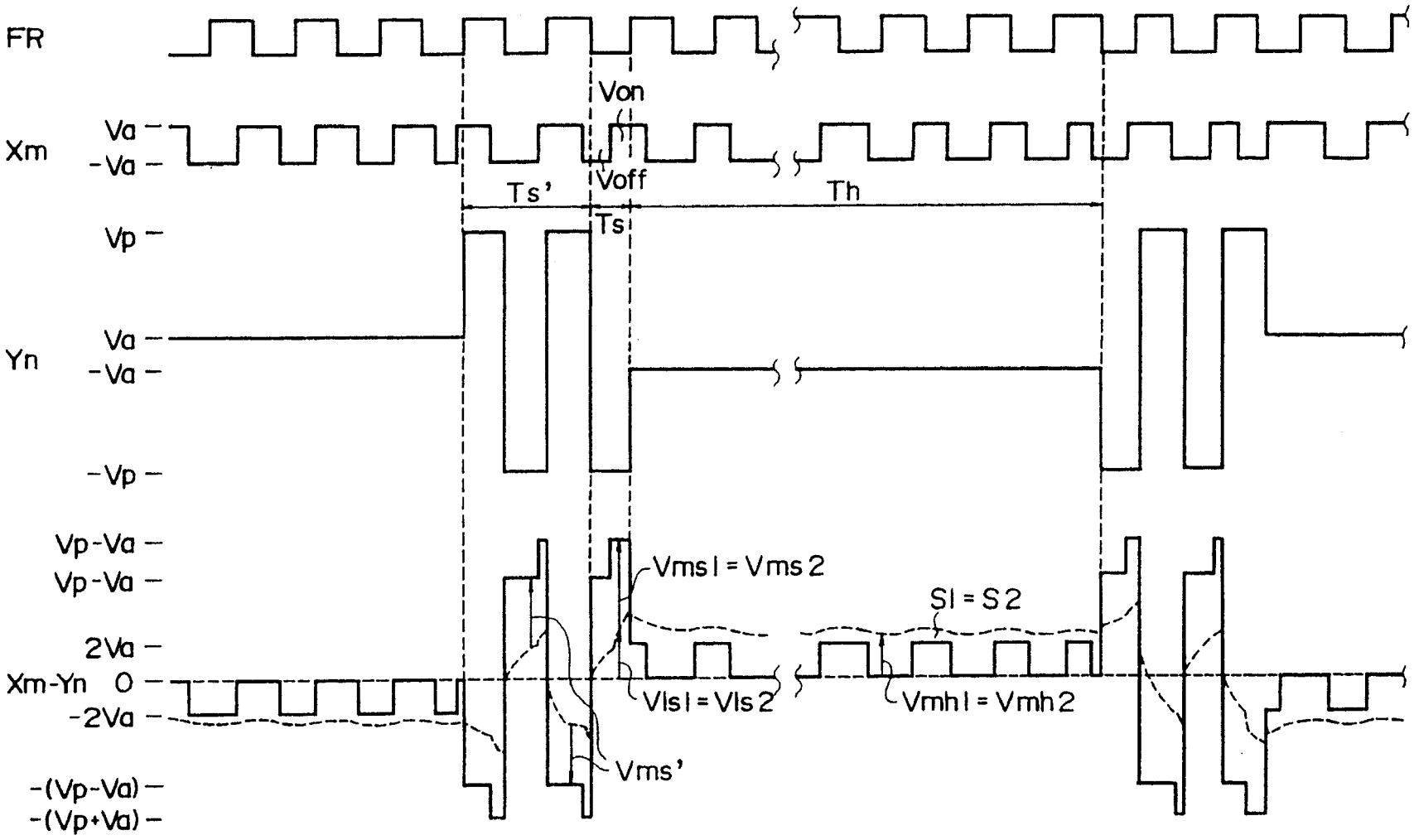
FIG. 23 is a timing chart further showing the driving method of the third embodiment.

Apparently from FIG. 23, when a black or white pattern is first displayed and then the display is switched to the same half tone level, the difference signal applied for the selection period $T_S$ is equal between both cases, and $V_{ms1}=V_{ms2}$, so that the effective voltages also satisfy the following equation: $V_{ls1}=V_{ls2}$. Further, the effective voltages applied for the non-selection period $T_N$ satisfy the following equations: $V_{mn1}=V_{mn2}$, and S1=S2. Therefore, as described above, the accumulation of the d.c. offset component due to the characteristic of the two-terminal active element can be prevented, and the occurrence of the afterimage phenomenon can be depressed.

In addition, the reset period $T_S$ is circulatingly provided to each of the row electrodes $Y_1$ to $Y_N$ every one-field or one-frame period, and thus the reset period $T_S$' every three horizontal scanning periods (SH) merely corresponds to a period of several % of the one-field or one-frame period. Accordingly, the fluctuation of the voltage applied to the liquid crystal layer is remarkably slight even when the high voltage is applied to the liquid crystal layer for the reset period $T_S$' according to the driving method of this embodiment, and thus the application of the high voltage to the liquid crystal layer never causes the degradation of display quality. In this embodiment, the reset period $T_S$' is set to three-horizontal scanning period. However, the reset period $T_S$' is not necessarily limited to this value, and may be set to a period above the above period or any value insofar as the degradation of display quality due to the voltage fluctuation is not induced. Further, the reset period $T_r$ may be shorter than that of this embodiment by increasing the applied voltage in the reset period $T_r$.

Further, the high voltage as used in the second embodiment is not applied for the reset period in the third embodiment, and thus it is not required to apply an excessive voltage to the liquid crystal layer and the two-terminal active element, so that the deterioration of the liquid crystal panel with time lapse can be prevented. In addition, a power generator for independently generating a high voltage for a reset operation is not required, so that the switching circuit provided between the Y shift register 605 and the row electrodes $Y_1$ to $Y_N$ can be simplified in construction.

A fourth embodiment of this invention will be next described with reference to FIGS. 24 through 26. like the second and third embodiments, this embodiment has been implemented in view of the problem of the degradation of display quality due to the shift characteristic that the I-V characteristic is shifted in accordance with the voltage applied to the two-terminal active element (the second problem). However, the occurrence of the afterimage phenomenon is prevented by compensating for the shift characteristic of the two-terminal active element for a period except for an actual displaying operation period.

Figure 14:
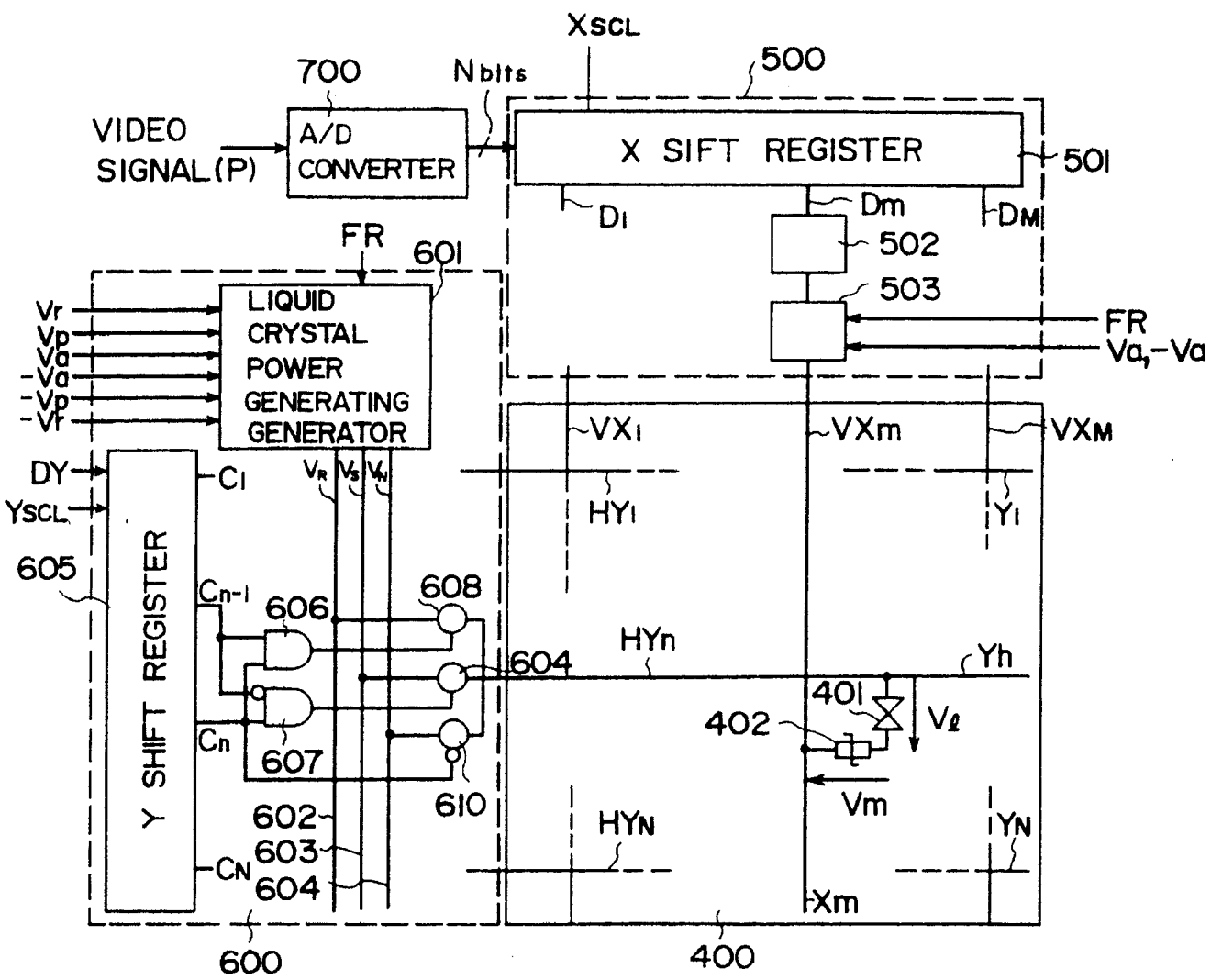
FIG. 14 is a circuit diagram showing the construction of the active matrix type liquid crystal display device to which a second embodiment of the driving method according to this invention is applied.

The construction of the active matrix type liquid crystal display device has the same construction as that of FIG. 14. However, the set of driving circuits (in figure, a driving circuit 503 is representatively shown) provided in the X-drive circuit 500 is supplied with six kinds of voltages $V_r/2$, $V_p/2$, $V_a/2$, $-V_r/2$,$-V_p/2$, $-V_a/2$, in place of the voltages $V_a$ and $-V_a$. In addition, the liquid crystal power generating circuit 601 is supplied with $V_r/2$, $V_p/2$, $V_a/2$, $-V_r/2$, $-V_p/2$, $-V_a/2$, in place of the voltages $V_r$, $V_p$, $V_a$, $-V_r$, $-V_p$, $-V_a$. These voltages satisfy the following inequality: $|V_r|>|V_p|>|V_a|$.

The operation of this embodiment will be next described with reference to timing charts of FIGS. 24 through 26.

Figure 24:
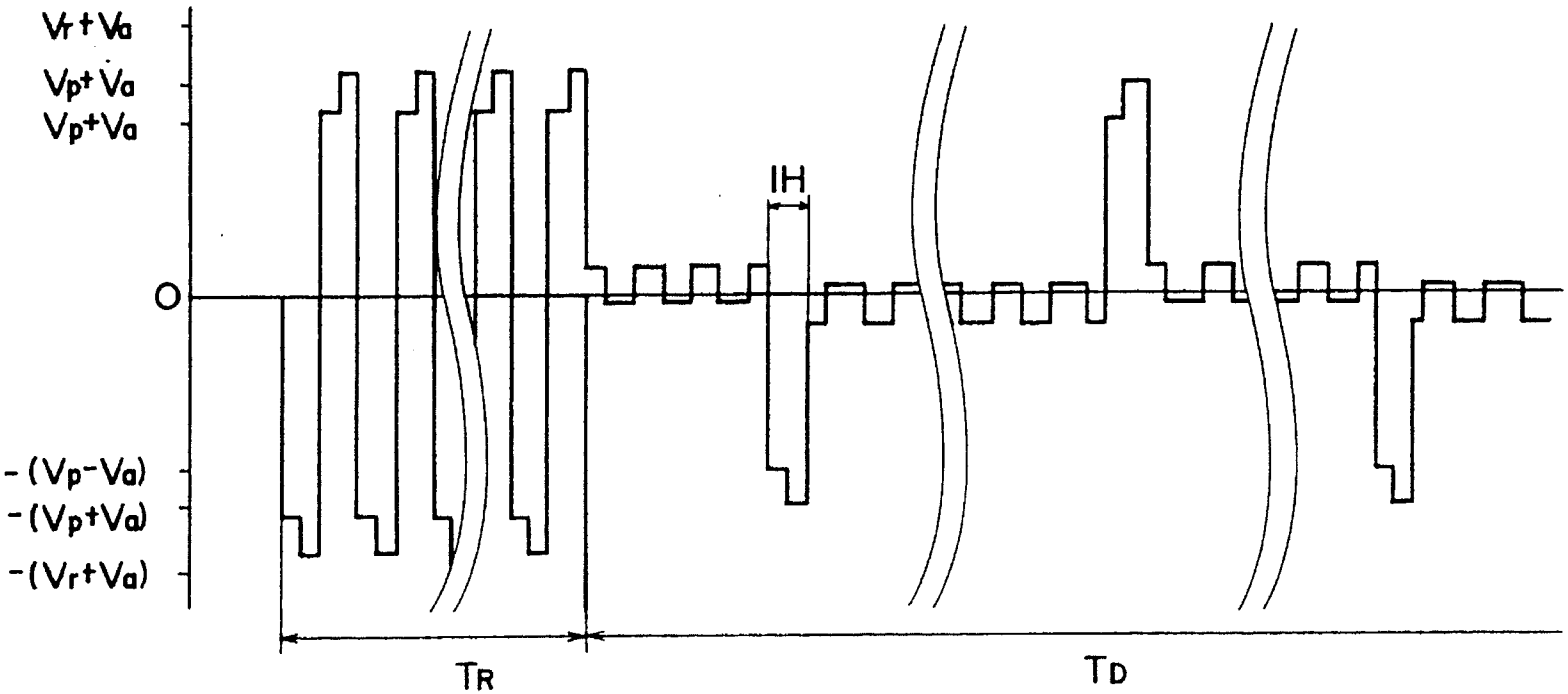
FIG. 24 is a timing chart further showing the driving method of a fourth embodiment.

As shown in FIG. 24, in this embodiment a period from the time when a power of the liquid crystal display device is switched on by an user or the like until the time when an actual displaying operation starts is defined as a refresh period $T_R$, and a period for which the actual display operation is carried out after the refresh period $T_R$ is defined as a display period $T_D$.

Figure 25A:
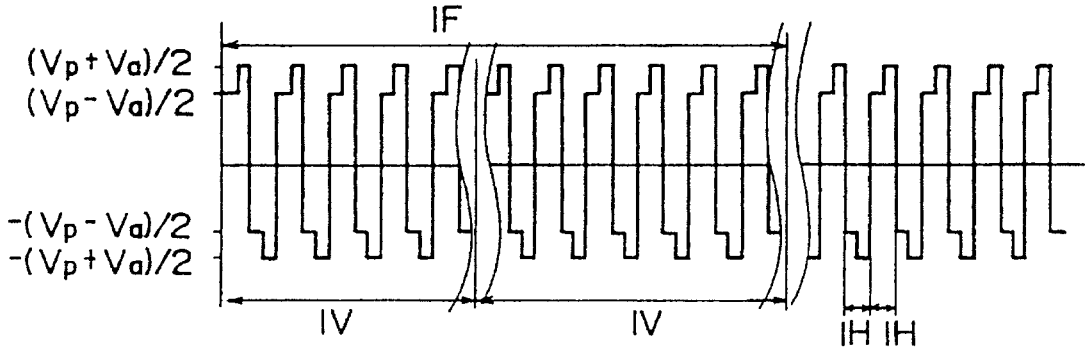
FIGS. 25(*a*) and (*b*) is a timing chart further showing the driving method of the fourth embodiment.
Figure 25B:
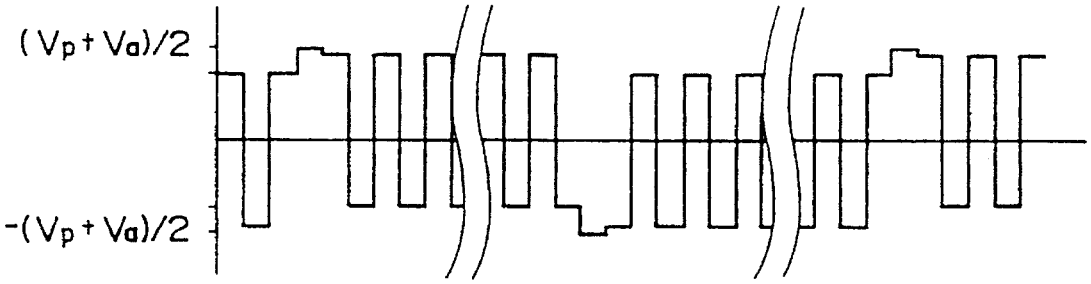

First, for the display period $T_D$ as shown in FIG. 25(*a*), a vide signal is subjected to the pulse width modulation to be converted to rectangular column electrode signals $VX_1$ to $VX_M$, and these converted column electrode signals are supplied to the column electrodes $X_1$ to $X_N$ in synchronism with the timing of the line-sequential scan. Simultaneously, rectangular row electrode signals $X_1$ to $X_N$ as shown in FIG. 25(*b*) are supplied to the row electrodes $Y_1$ to $Y_N$ in synchronism with the timing of the line-sequential scan. From the potential difference between these column electrode signals and row electrode signals, a difference signal as shown in FIG. 24 is formed for the display period $T_D$. In FIG. 24, one-frame period, one-field period and one-horizontal period are represented by 1F, 1V and 1H.

Figure 26A:
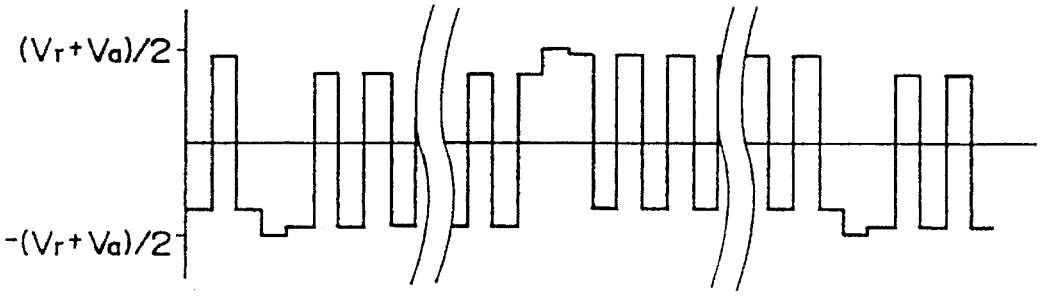
FIGS. 26(*a*) and (*b*) is a timing chart further showing the driving method of the fourth embodiment.
Figure 26B:
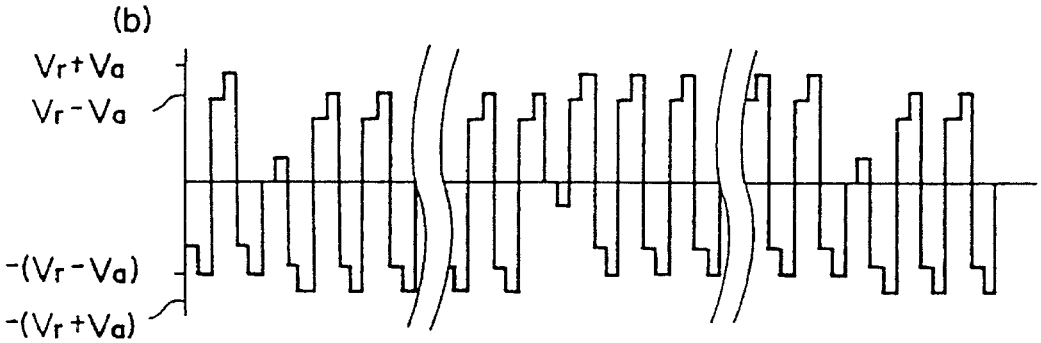

As shown in FIG. 26(*a*), for the refresh period $T_R$ which is set before the display period $T_D$, the row electrode signals $HY_1$ to $HY_N$ applied to the row electrodes $Y_1$ to $Y_N$ are deviated in phase from the row electrode signals as shown in FIG. 25(*b*) by 180°, and thus voltages of $(V_r+V_a)/2$ and $-(V_r+V_a)$ are outputted in place of $(V_p+V_a)/2$ and $-(V_p+V_a)$. Simultaneously with the application of the row electrode signals $HY_1$ to $HY_N$ as shown in FIG. 26(*a*) to the row electrodes $Y_1$ to $Y_N$, the column electrode signals $VX_1$ to $VX_M$ which have rectangular forms as shown in FIG. 25(*a*) and output voltages of $(V_r+V_a)/2$, $(V_r-V_a)/2$, $-(V_r-V_a)/2$, $-(V_r-V_a)/2$ (in place of $(V_r+V_a)/2$, $(V_p-V_a)/2$, $-(V_p-V_a)/2$, $-(V_r-V_a)/2$) are applied, thereby obtaining difference signals having waveforms as shown in FIG. 26(*b*). The difference signal as shown in FIG. 26(*b*) corresponds to the signal in the refresh period $T_R$ as shown in FIG. 24.

In this embodiment, a high voltage is also beforehand applied between the set of column electrodes and the set of row electrodes for the refresh period $T_R$ to shift the I-V characteristic of the two-terminal active element to the I-V characteristic at the high voltage region, so that the I-V characteristic is fixed for a next normal display period $T_D$. Therefore, the accumulation of the d.c. offset component is prevented, and thus the occurrence of the afterimage phenomenon can be depressed.

Figure 27A:
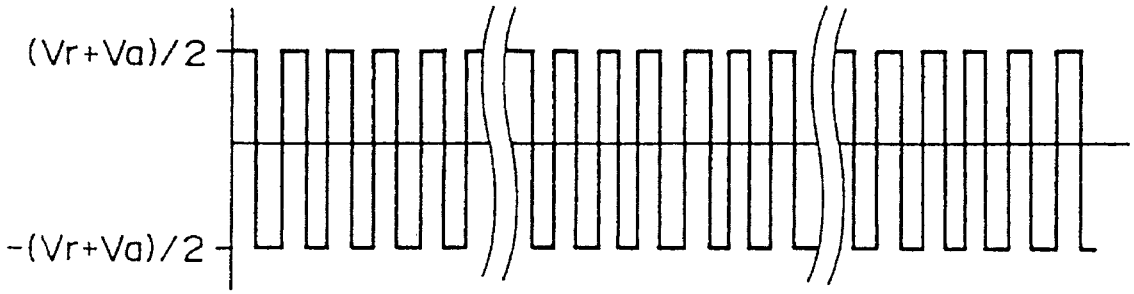
FIGS. 27(*a*)–(*b*) is a timing chart showing a fifth embodiment of the driving method according to this invention.
Figure 27B:
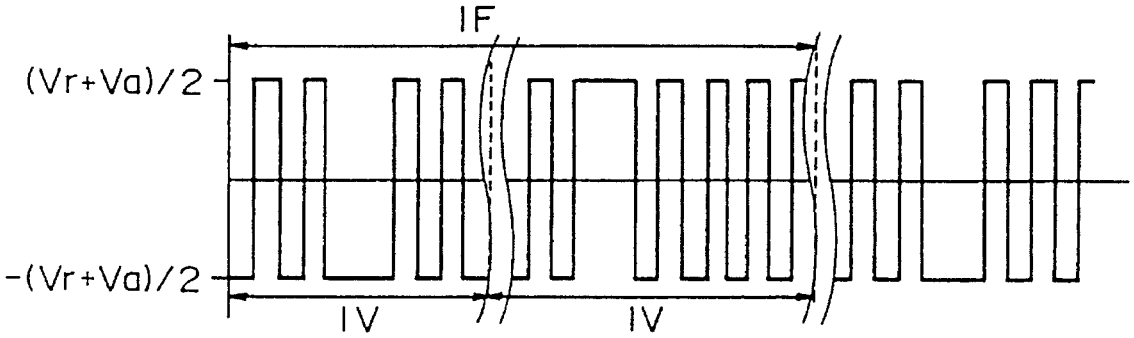
Figure 27C:
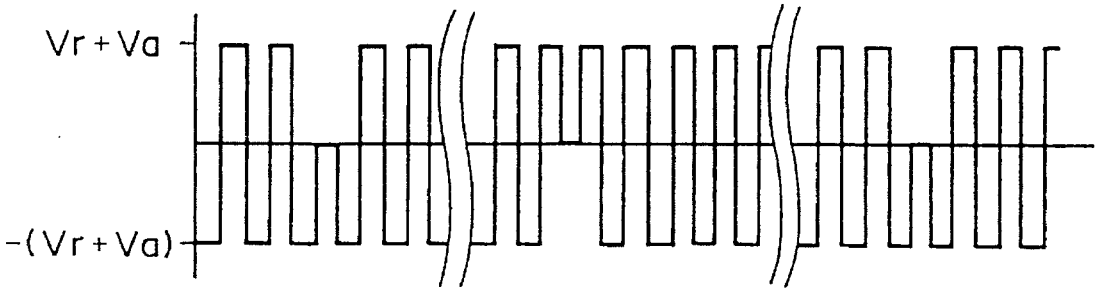

A fifth embodiment will be next described with reference to FIG. 27. The active matrix type liquid crystal display device to which this embodiment is applied has the same construction as the fourth embodiment (see FIG. 14). The feature of this embodiment resides in that the waveform of a difference signal having high amplitude voltage applied for the refresh period $T_R$ is designed so as to have a completely rectangular waveform as shown in FIG. 27(*c*). In order to obtain the difference signal having the completely rectangular waveform, a waveform as shown in FIG. 27(*a*) is assigned to the column electrode signals $VX_1$ to $VX_M$ while a waveform as shown in FIG. 27(*b*) is assigned to the row electrode signals $HY_1$ to $HY_N$. In figures, one-frame period, one-field period and one-horizontal period are represented by 1F, 1V and 1H, respectively.

According to this embodiment, a high voltage can be easily obtained, and the compensation of the electrical characteristic of the two-terminal active element can be easily performed.

Figure 28:
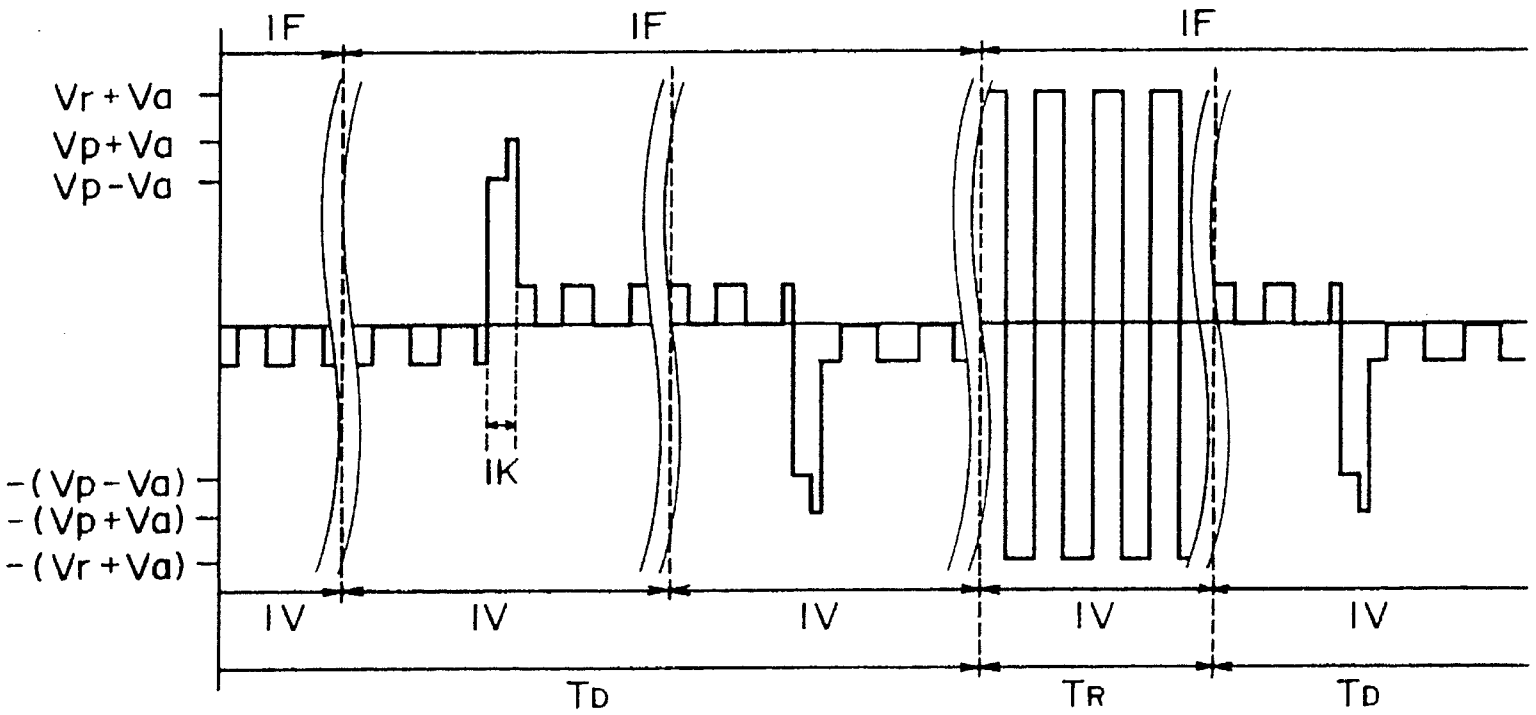
FIG. 28 is a timing chart showing a sixth embodiment of the driving method according to this invention.

A sixth embodiment of this invention will be next described hereunder with reference to FIG. 28. The active matrix type liquid crystal display device of this embodiment has the same construction as the fourth embodiment (see FIG. 14). However, in this embodiment, the refresh period $T_R$ is suitably inserted in the display period $T_D$ to periodically compensate for the shift characteristic of the two-terminal active element. According to this method, the compensating operation is periodically carried out and thus the shift characteristic of the two-terminal active element can be surely compensated. However, if the refresh period $T_R$ is set to an excessively long time, then the normal display period $T_D$ would be damaged, and thus the refresh period $T_r$ is preferably inserted every several seconds, one-horizontal scanning period or one-vertical scanning period.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

We claim:

1. A method of driving a liquid crystal device having column and row electrodes and a plurality of picture elements, each picture element including a liquid crystal layer and a two-terminal type element serially connected between said column and row electrodes, said two-terminal type element having a predetermined characteristic in which when voltage applied between both edges of said two-terminal type element is high, the resistance of said two-terminal type element becomes low, and when voltage applied between the both edges of said two-terminal type element is low, the resistance of said two-terminal type element becomes high, said method comprising the steps of:

applying a row electrode signal to said row electrodes to periodically scan said row electrodes, said row electrode signal having a selection period and a non-selection period following the selection period; and applying a data signal to said column electrode, said data signal corresponding to display information to be displayed in said picture element, said selection period in said row electrode signal having a positive-polarity selection period in which positive polarity voltage is lastly charged to said liquid crystal layer to write the display information into said picture element, and a negative-polarity selection period in which negative polarity voltage is lastly charged to said liquid crystal layer to write the display information into said picture element, wherein when said two-terminal type element has a current-voltage characteristic in which a current value corresponding to a voltage applied between the edges of said two-terminal type element in said positive-polarity selection period is larger than that in said negative-polarity selection period, the positive-polarity selection period is shorter than said negative-polarity selection period.

2. The method according to claim 1, wherein said positive polarity voltage and said negative polarity voltage have polarities such that the data signal is substracted from the row electrode signal when applied to the picture elements.

3. The method according to claim 2, wherein said positive-polarity selection period and said negative-polarity selection period are set based on an electrical measurement result obtained in a process of manufacturing the liquid crystal display.

4. The method according to claim 2, wherein said positive-polarity selection period and said negative-polarity selection period are generated based on an A.C. inversion signal having a high level period and a low level period, the high level period being different from the low level period.

5. The method according to claim 1, wherein said positive-polarity selection period and said negative-polarity selection period are set based on an electrical measurement result obtained in a process of manufacturing the liquid crystal display.

6. The method according to claim 1, wherein said positive-polarity selection period and said negative-polarity selection period are generated based on an A.C. inversion signal having a high level period and a low level period, the high level period being different from the low level period.

7. A method of driving a liquid crystal device having column and row electrodes and a plurality of picture elements, each picture element including a liquid crystal layer and a two-terminal type element serially connected between said column and row electrodes, said two-terminal type element having a predetermined characteristic in which when voltage applied between both edges of said two-terminal type element is high, the resistance of said two-terminal type element becomes low, and when voltage applied between the both edges of said two-terminal type element is low, the resistance of said two-terminal type element becomes high, said method comprising the steps of:

applying a row electrode signal to said row electrodes to periodically scan said row electrodes, said row electrode signal having a selection period and a non-selection period following the selection period; and applying a data signal to said column electrode, said data signal corresponding to display information to be displayed in said picture element, said selection period in said row electrode signal having a positive-polarity selection period in which positive polarity voltage is lastly charged to said liquid crystal layer to write the display information into said picture element, and a negative-polarity selection period in which negative polarity voltage is lastly charged to said liquid crystal layer to write the display information into said picture element, wherein when said two-terminal type element has a current-voltage characteristic in which a current value corresponding to a voltage applied between the edges of said two-terminal type element in said positive-polarity selection period is smaller than that in said negative-polarity selection period, and the positive-polarity selection period is longer than said negative-polarity selection period.

8. The method according to claim 7, wherein said positive polarity voltage and said negative polarity voltage have polarities such that the data signal is substracted from the row electrode signal when applied to the picture elements.

9. The method according to claim 8, wherein said positive-polarity selection period and said negative-polarity selection period are set based on an electrical measurement result obtained in a process of manufacturing the liquid crystal display.

10. The method according to claim 8, wherein said positive-polarity selection period and said negative-polarity selection period are generated based on an A.C. inversion signal having a high level period and a low level period, the high level period being different from the low level period.

11. The method according to claim 7, wherein said positive-polarity selection period and said negative-polarity selection period are set based on an electrical measurement result obtained in a process of manufacturing the liquid crystal display.

12. The method according to claim 7, wherein said positive-polarity selection period and said negative-polarity selection period are generated based on an A.C. inversion signal having a high level period and a low level period, the high level period being different from the low level period.

* * * * *